US012612912B2

(12) United States Patent
Akagi et al.

(10) Patent No.: US 12,612,912 B2
(45) Date of Patent: Apr. 28, 2026

(54) CONTROL DEVICE FOR HYDRAULIC CONTROL VALVE

(71) Applicant: Hitachi Astemo, Ltd., Hitachinaka (JP)

(72) Inventors: Yoshihiko Akagi, Hitachinaka (JP); Koji Saga, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 4 days.

(21) Appl. No.: 18/726,182

(22) PCT Filed: Jan. 31, 2022

(86) PCT No.: PCT/JP2022/003608
§ 371 (c)(1),
(2) Date: Jul. 2, 2024

(87) PCT Pub. No.: WO2023/145073
PCT Pub. Date: Aug. 3, 2023

(65) Prior Publication Data
US 2025/0101979 A1 Mar. 27, 2025

(51) Int. Cl.
*F04C 14/24* (2006.01)
*F01L 1/344* (2006.01)
(Continued)

(52) U.S. Cl.
CPC ..... *F04C 14/24* (2013.01); *F01L 1/3442* (2013.01); *F01L 2001/34426* (2013.01);
(Continued)

(58) Field of Classification Search
CPC combination set(s) only.
See application file for complete search history.

(56) References Cited

U.S. PATENT DOCUMENTS

2002/0026914 A1* 3/2002 Maeyama ..... F01L 1/344 123/90.15
2009/0071426 A1* 3/2009 Knecht ..... F15B 11/024 91/462
(Continued)

FOREIGN PATENT DOCUMENTS

JP 2016-11680 A 1/2016
JP 2016-31112 A 3/2016

OTHER PUBLICATIONS

International Search Report (PCT/ISA/210) issued in PCT Application No. PCT/JP2022/003608 dated Mar. 1, 2022 with English translation (5 pages).
(Continued)

*Primary Examiner* — Binh Q Tran
(74) *Attorney, Agent, or Firm* — Crowell & Moring LLP

(57) ABSTRACT

Provided is a control device for a hydraulic control valve that can increase an efficiency of removing a foreign matter clogged in the hydraulic control valve. A control device controls a hydraulic control valve that controls a pump capacity of a variable displacement oil pump. The hydraulic control valve includes a sleeve and a spool valve that moves in the sleeve, and is configured to change a pump capacity by controlling an oil pressure by moving a spool valve between one end portion and the other end portion in the sleeve. The control device for the hydraulic control valve includes: a drive control unit that controls driving of the spool valve; and a determination unit that determines whether or not clogging of a foreign matter exists between a sleeve and the spool valve, and determines a position of the clogging of the foreign matter in a case where the foreign matter exists between a sleeve and the spool valve, and determines a position of the clogging of a foreign matter in a case where the clogging of a foreign matter exists.

4 Claims, 17 Drawing Sheets

(51) Int. Cl.

| | |
|---|---|
| ***F04C 13/00*** | (2006.01) |
| ***F04C 29/00*** | (2006.01) |
| ***F04C 29/02*** | (2006.01) |

(52) U.S. Cl.
CPC .. *F01L 2001/34443* (2013.01); *F01L 2800/11* (2013.01); *F01L 2800/12* (2013.01); *F01L 2820/031* (2013.01); *F04C 13/005* (2013.01); *F04C 29/0092* (2013.01); *F04C 29/02* (2013.01); *F04C 2270/16* (2013.01); *F04C 2280/02* (2013.01)

(56) References Cited

U.S. PATENT DOCUMENTS

| | | | | |
|---|---|---|---|---|
| 2010/0028168 | A1* | 2/2010 | Shimizu | F16H 61/0031 417/364 |
| 2015/0377375 | A1* | 12/2015 | Takagi | F16K 31/0613 137/242 |
| 2017/0022854 | A1* | 1/2017 | Takada | F01L 1/047 |
| 2018/0223840 | A1* | 8/2018 | Naganuma | F04C 2/344 |
| 2020/0032793 | A1* | 1/2020 | Saga | F04C 14/223 |

OTHER PUBLICATIONS

Japanese-language Written Opinion (PCT/ISA/237) issued in PCT Application No. PCT/JP2022/003608 dated Mar. 1, 2022 with English translation (5 pages).
Japanese-language Office Action issued in Japanese Application No. 2023-576584 dated Jun. 17, 2025 with English translation (8 pages).

* cited by examiner

FIG. 20

| TYPE | ESTIMATED CONTENT | CONTENT OF CONTROL | ADVANTAGEOUS EFFECTS |
|---|---|---|---|
| CLEANING A CONTROL (VIBRATION MODE) | TIMING: IMMEDIATELY AFTER OCCURRENCE OF ABNORMALITY PHENOMENON: PHENOMENON WHERE FOREIGN MATTER STICKS TO SPOOL VALVE STICKING BEING SMALL | FLOWS OUT FOREIGN MATTER BY VIBRATION BY CHANGING CURRENT IN A DIRECTION OPPOSITE TO CORRECTION CURRENT CALCULATED BY OIL PRESSURE FEEDBACK CONTROL BASED ON TARGET CONTROL CURRENT | CAN REMOVE FOREIGN MATTER STUCK TO SPOOL VALVE WITHOUT APPLYING EXCESSIVE FORCE TO FOREIGN MATTER |
| CLEANING B CONTROL (PEELING-OFF MODE) | TIMING: CASE WHERE OIL PRESSURE IS LOW SO THAT FOREIGN MATTER CANNOT BE REMOVED PHENOMENON: ESTIMATE PHENOMENON WHERE OIL PRESSURE IS LOW SO THAT SPOOL ADVANCES AND DOES NOT RETURN | ELECTRICITY SUPPLIED TO SOLENOID IS CHANGED FROM 0 TO 100% WITH RESPECT TO STICKING OF FOREIGN MATTER ON A LOW OIL PRESSURE SIDE SUPPLY ELECTRICITY FOR TIME LONGER THAN TIME IN SCRAPING MODE (DISTANCE TO SPOOL VALVE IS REMOTE SO THAT STROKE OF SOLENOID IS LONG) | INCREASE PEELING-OFF SUCCESS RATE BY SELECTIVELY IMPARTING IMPACT TO STICKING ON A LOW OIL PRESSURE SIDE |
| CLEANING C CONTROL (SCRAPING-OFF MODE) | TIMING: CASE WHERE OIL PRESSURE IS HIGH SO THAT FOREIGN MATTER CANNOT BE SCRAPED OFF PHENOMENON: ESTIMATE PHENOMENON WHERE OIL PRESSURE IS HIGH SO THAT SPOOL CANNOT BE PUSHED BY SOLENOID | ELECTRICITY SUPPLIED TO SOLENOID IS CHANGED FROM 0 TO 100% WITH RESPECT TO STICKING OF FOREIGN MATTER ON A HIGH OIL PRESSURE SIDE SUPPLY ELECTRICITY FOR SHORT TIME (DISTANCE TO SPOOL VALVE IS SHORT SO THAT STROKE OF SOLENOID IS SHORT) | INCREASE SCRAPING-OFF SUCCESS RATE BY SELECTIVELY IMPARTING IMPACT TO STICKING ON A HIGH OIL PRESSURE SIDE |

CONTROL DEVICE FOR HYDRAULIC CONTROL VALVE

TECHNICAL FIELD

The present invention relates to a control device for a hydraulic control valve.

BACKGROUND ART

In recent years, it is required to reduce a friction in an engine in order to increase the efficiency of an internal combustion engine. Along with such a demand, an oil pump of the internal combustion engine is required to realize the supply of an oil to the internal combustion engine that leads to the increase of the efficiency of the internal combustion engine. As such an oil pump, there has been known a variable displacement oil pump where pump capacity is controlled by a spool valve.

PTL 1 discloses a technique for removing a foreign matter mixed in a spool valve of a variable displacement oil pump. The control device for the hydraulic control valve disclosed in PTL 1 eliminates a foreign matter by vibrating the spool valve at one end portion or the other end portion in the sleeve of the hydraulic control valve when a seizure of foreign matter occurs.

Further, PTL 1 discloses a technique for determining whether or not a foreign matter is sticking based on a target discharge oil pressure and an actual discharge pressure.

CITATION LIST

Patent Literature

PTL 1: JP 2016-11680 A

SUMMARY OF INVENTION

Technical Problem

However, as disclosed in PTL 1, even when the spool is vibrated at one end portion or the other end portion in the sleeve, a vibration force of the spool valve may increase a fixing force of a foreign matter depending on the position of the foreign matter in the sleeve. As a result, there is a possibility that it is difficult to remove the foreign matter by vibrating the spool valve.

The present invention has been made in view of the above-mentioned problems, and it is an object of the present invention to enhance a removal ratio of a foreign matters clogged in a hydraulic control valve.

Solution to Problem

A control device that solves the above-mentioned object and achieves the object of the present invention controls a hydraulic control valve that controls a pump capacity of a variable displacement oil pump. The hydraulic control valve includes a sleeve and a spool valve that moves in the sleeve, and is configured to change a pump capacity by controlling an oil pressure by moving a spool valve between one end portion and the other end portion in the sleeve. The control device for the hydraulic control valve includes: a drive control unit that controls driving of the spool valve; and a determination unit that determines whether or not clogging of a foreign matter exists between a sleeve and the spool valve, and determines a position of the clogging of the foreign matter in a case where the foreign matter exists between a sleeve and the spool valve, and determines a position of the clogging of a foreign matter in a case where the clogging of a foreign matter exists.

Advantageous Effects of Invention

According to the present invention, it is possible to increase an efficiency of removing a foreign matter clogged in the hydraulic control valve.

Problems, configurations, and advantageous effects other than the above will be clarified by the description of the following embodiments.

BRIEF DESCRIPTION OF DRAWINGS

FIG. 20 is a table illustrating the contents of a cleaning control that ECU according to the embodiment 1 is performed.

DESCRIPTION OF EMBODIMENTS

Embodiment

Figure 1:
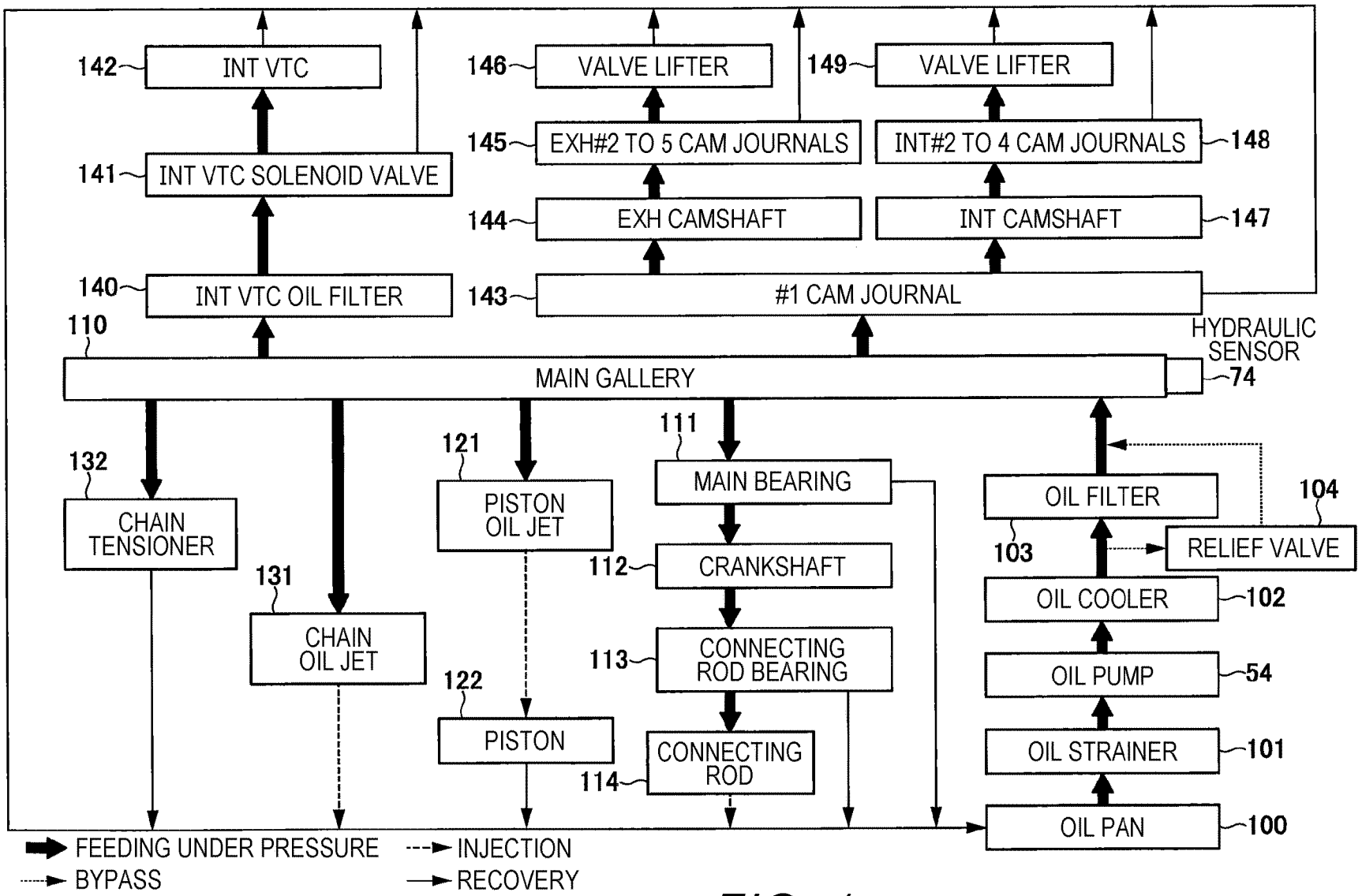
FIG. 1 is an explanatory block diagram of an oil pressure passage of an internal combustion engine.

Hereinafter, a control device for a hydraulic control valve according to an embodiment will be described. In the respective drawings, the substantially equal members are denoted by the same reference numerals.

[Oil Pressure Passage]

First, FIG. 1 illustrates an oil pressure passage of an internal combustion engine with respect to portions that use oil for the internal combustion engine.

As illustrated in FIG. 1, the oil is supplied from an oil pan 100 to a main gallery 110 through an oil strainer 101, the variable displacement oil pump 54, an oil cooler 102, and an oil filter 103. A portion of the oil is supplied from the oil cooler 102 to the main gallery 110 through a relief valve 104.

The oil supplied to the main gallery 110 is supplied to a variable valve mechanism 142 through an internal variable valve mechanism oil filter 140, and an internal variable valve mechanism solenoid valve 141. The oil supplied to the main gallery 110 is supplied to an external camshaft 144 through a cam journal 143 and, thereafter, supplied to a valve lifter 146 through an external cam journal 145. Further, the oil supplied to the main gallery 110 is supplied to a valve lifter 149 through an internal camshaft 147 and an internal cam journal 148.

The oil supplied to the main gallery 110 is supplied to a main bearing 111, a crankshaft 112, a connecting rod bearing 113, and a connecting rod 114. The oil supplied to the main gallery 110 is supplied to a chain tensioner 132, a chain oil jet 131, and a piston oil jet 121. The chain oil jet 131 injects the supplied oil. The piston oil jet 121 injects the supplied oil to a piston 122.

The oil supplied or injected to the respective units is collected in the oil pan 100, and thereafter, supplied to the main gallery 110 again.

[Principle of Plain Bearing]

Next, the principle of the plain bearing is described with reference to FIG. 2.

Figure 2:
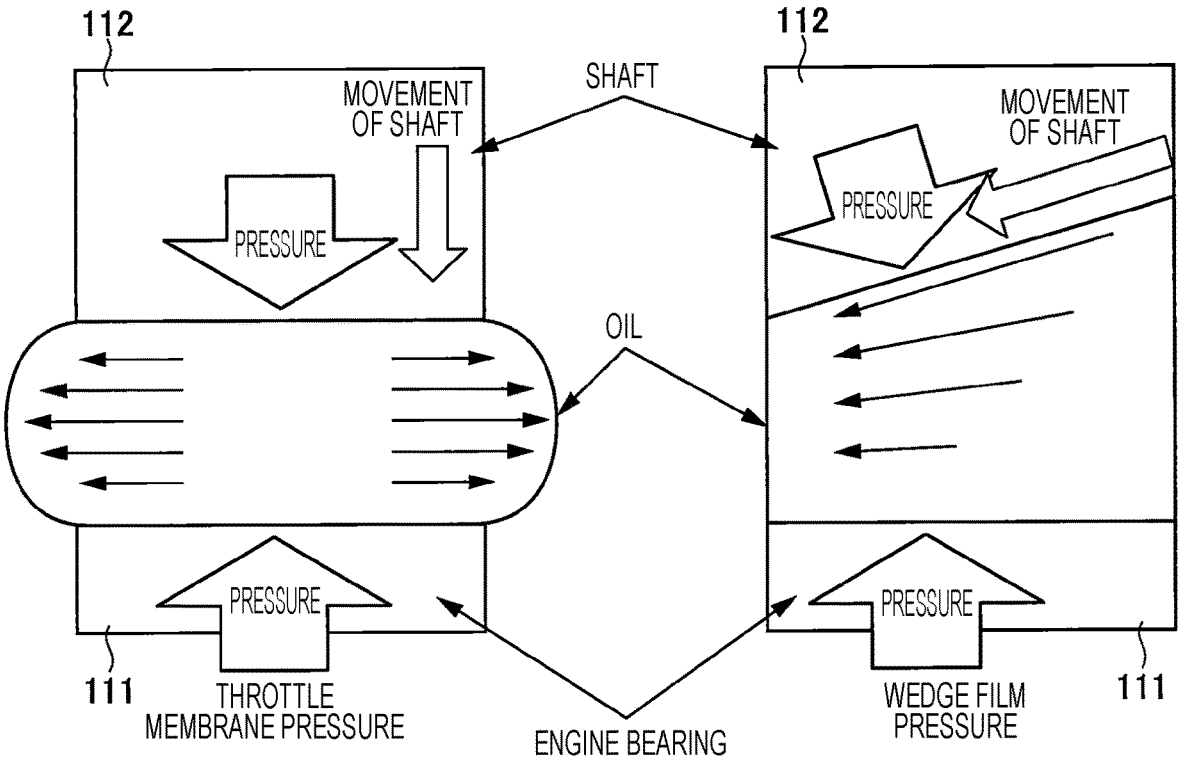
FIG. 2 is a block diagram for explaining a function of lubrication of oil in a plain bearing.

FIG. 2 is a diagram illustrating a function of lubrication of oil in a plain bearing such as a main bearing of an engine.

The right side in FIG. 2 illustrates a mode where a portion of the crankshaft 112 is viewed in an axial direction with respect to the main bearing 111 fixed to the engine. When the shaft of the crankshaft 112 rotates and moves from the upper right side to the lower side left in FIG. 2, the oil enters between the main bearing 111 and the crankshaft 112 like a wedge while being dragged toward a left side by viscosity of the oil. As a result, a wedge film pressure is generated in the oil. As a result, the oil provides the lubrication between the main bearing 111 and the crankshaft 112.

The left side of FIG. 2 illustrates a mode where the main bearing 111 and the crankshaft 112 are viewed from an axial side surface. The oil is prevented from leaking to a side surface of the main bearing 111 due to its viscosity against a load from above by the crankshaft 112. As a result, the oil provides the lubrication between the main bearing 111 and the crankshaft 112.

In this manner, both a phenomena generated on a right side and a phenomenon generated on a left side in FIG. 2 provide the lubrication by the viscosity of the oil. Accordingly, it is understood that the viscosity of the oil is important for lubrication.

[Action Due to Oil and Displacement of Oil]

Figure 3:
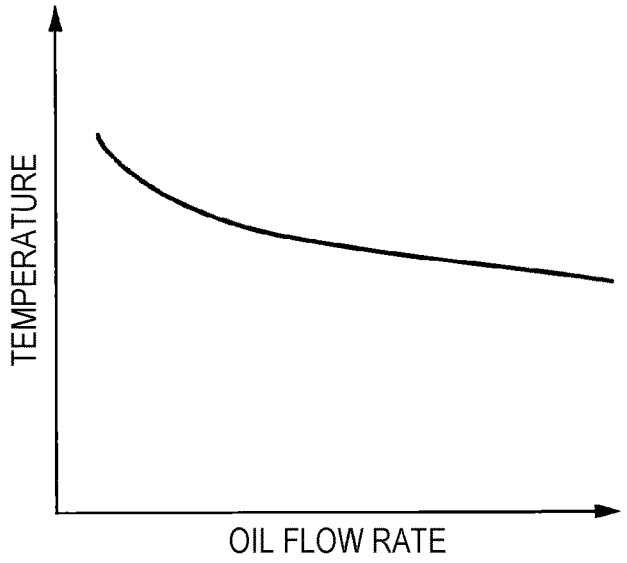
FIG. 3 is a graph illustrating a relationship between an amount of oil and a temperature.
Figure 4:
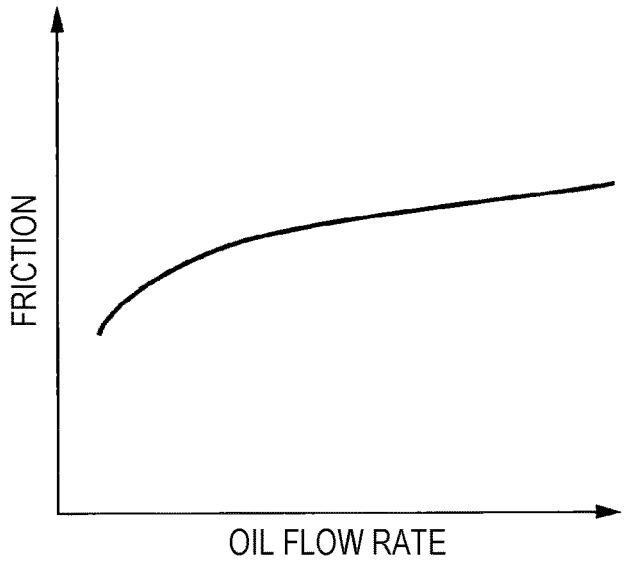
FIG. 4 is a graph illustrating a relationship between an amount of oil and friction.
Figure 5:
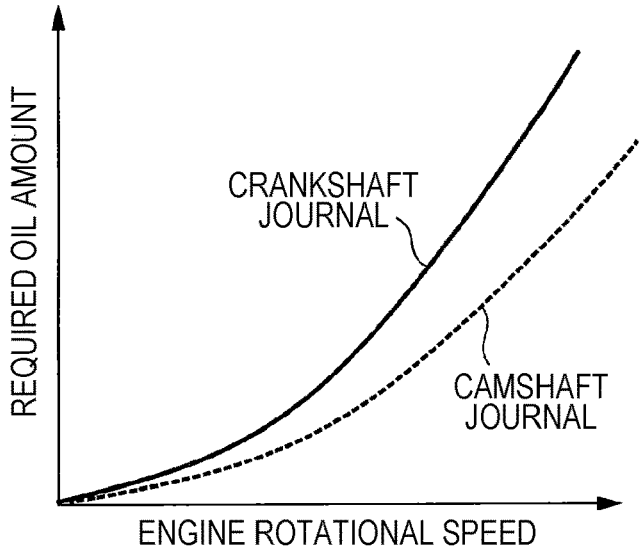
FIG. 5 is a graph illustrating a relationship between an engine rotational speed and a required amount of oil.

Next, the action due to oil and the displacement of the oil will be described with reference to FIG. 3 to FIG. 5. FIG. 3 is a graph illustrating a relationship between an amount of oil and a temperature. FIG. 4 is a graph illustrating a relationship between an amount of oil and friction. FIG. 5 is a graph illustrating a relationship between an engine rotational speed and a required amount of oil.

FIG. 3 illustrates the relationship between an amount of oil discharged from a variable displacement oil pump and a temperature. As illustrated in FIG. 3, the larger a flow rate of oil, the lower a temperature of the oil becomes. As a result, it is found that it is necessary to increase a displacement of oil in order to increase cooling capacity.

FIG. 4 illustrates a relationship between an amount of oil discharged from a variable displacement oil pump and a friction. As illustrated in FIG. 4, the larger a flow rate of the oil, a friction increases. As a result, it is found that it is necessary to reduce a displacement of oil in order to reduce the friction.

FIG. 5 illustrates a required amount of oil for a plain bearing, that is obtained from a rotational speed of an engine. As illustrated in FIG. 5, the higher a rotational speed of the engine, the larger a required amount of oil becomes. From the above, it is understood that it is necessary to determine a displacement of oil corresponding to a rotational speed of the engine.

[Configuration of Internal Combustion Engine]

Next, the configuration of an internal combustion engine will be described with reference to FIG. 6.

Figure 6:
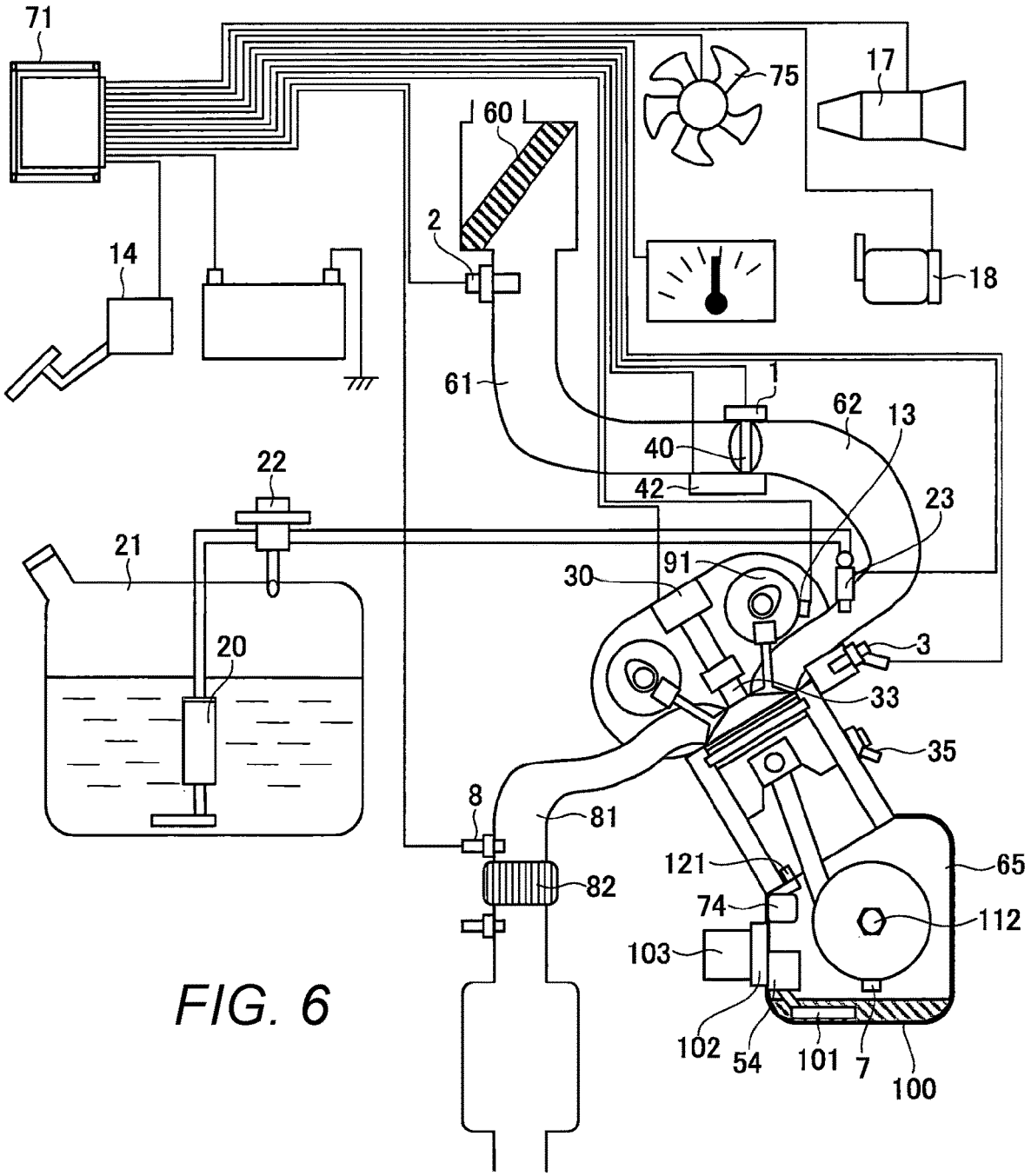
FIG. 6 is a block diagram of a control system of an internal combustion engine according to an embodiment 1.

FIG. 6 is a control system view of the internal combustion engine.

The internal combustion engine 65 illustrated in FIG. 6 may be a single-cylinder engine or a multi-cylinder engine. However, in the embodiment, an in-line four-cylinder internal combustion engine of a multi-cylinder fuel injection system will be described as an example.

Air sucked into the internal combustion engine 65 passes through an air cleaner 60 and is guided to an air flow sensor 2. A hot-wire air flow rate sensor is used as the air flow sensor 2. The air flow sensor 2 outputs a signal corresponding to an intake air amount. An intake air temperature sensor 2A (see FIG. 7) that uses a thermistor measures an intake air temperature, and outputs an intake air temperature signal.

The intake air that has passed through the air cleaner 60 passes through a duct 61 and a throttle valve 40 that controls a flow rate of the air, and enters a collector 62. The throttle valve 40 is operated by a throttle driving motor 42 driven by an ECU 71.

A throttle sensor 1 that detects an opening degree of the throttle valve 40 is mounted on the throttle valve 40. A sensor signal that the throttle sensor 1 outputs is inputted to an electronic control unit (ECU) 71. The ECU 71 is configured to perform a feedback control of an opening degree of the throttle valve 40, the detection of a fully closed position, the detection of acceleration, and the like based on a sensor signal of the throttle sensor 1. A target degree of opening of the feedback is acquired based on a step-in amount of accelerator detected by an acceleration degree-of-opening sensor 14 and an idling rotational speed control, that is, an ISC control.

Air that has entered the collector 62 is distributed to each intake pipe directly connected to the engine, and is sucked into a cylinder. An intake valve and an exhaust valve of the cylinder are opened and closed by a valve timing variable mechanism 91. The valve timing variable mechanism 91 is subjected to a feedback control based on a target angle.

A crank angle sensor 7 is mounted on the cylinder. The crank angle sensor 7 detects a rotation angle of a crankshaft 112. The crank angle sensor 7 outputs a pulse for every predetermined crank angle. An output of the crank angle sensor 7 is inputted to the ECU 71.

The fuel is sucked from the fuel tank 21 and is pressurized by the fuel pump 20. The fuel sucked and pressurized by the fuel pump 20 is adjusted to a predetermined pressure by a pressure regulator 22. Then, the fuel adjusted to a predetermined pressure is injected into the intake pipe from an injector 23 mounted on the intake pipe. An extra fuel after the pressure is adjusted by the pressure regulator 22 is returned to the fuel tank 21 through a return pipe.

An ignition plug 33 is mounted on an upper portion of the cylinder. The ignition plug 33 generates a spark by discharge. The spark ignites an air-fuel mixture in the cylinder. As a result, an explosion occurs in the cylinder, and a piston is pushed down. When the piston is pushed down, the crankshaft 112 rotates. An ignition coil that generates electric energy (voltage) is connected to the ignition plug 33.

The ignition plug 33 performs discharge for ignition at a timing corresponding to an ignition timing obtained according to a rotational speed of the engine. When the ignition timing is too early, knocking occurs in the cylinder. A knock sensor 35 mounted on the cylinder detects the vibration of the cylinder caused by knocking. When the ECU 71 determines that knocking has occurred based on a detection result of the knock sensor 35, the ECU 71 performs a knock control so as to retard the ignition timing.

A water temperature sensor 3 for detecting a cooling water temperature is mounted on the internal combustion engine 65. A sensor signal outputted from the water temperature sensor 3 is inputted to the ECU 71. The ECU 71 detects a warm-up state of the internal combustion engine 65 based on a sensor signal outputted from the water temperature sensor 3. Then, the ECU 71 performs the increase of a fuel injection amount, the correction of ignition timing, turning on/off of a radiator fan 75, and setting of a target rotational speed during idling.

Signals outputted from a neutral switch 17 and an air conditioner switch 18 are inputted to the ECU 71. The neutral switch 17 is built in a transmission that monitors the state of a drive system. The air conditioner switch 18 monitors the state of an air conditioner clutch. The ECU 71 calculates a target rotational speed and a load correction amount during idling based on signals outputted from the neutral switch 17 and the air conditioner switch 18.

An air-fuel ratio sensor 8 is mounted on an exhaust pipe 81 of the engine. The air-fuel ratio sensor 8 outputs a signal corresponding to the concentration of oxygen in an exhaust gas. The signal outputted from the air-fuel ratio sensor 8 is inputted to the ECU 71. The ECU 71 adjusts a fuel injection pulse width based on a signal outputted from the air-fuel ratio sensor 8 such that an air-fuel ratio becomes a target air-fuel ratio acquired according to an operation situation.

A catalyst 82 is disposed in the exhaust pipe 81. The catalyst 82 purifies an exhaust gas. The exhaust gas purified by the catalyst 82 is discharged to the atmosphere.

[Sensors, Switches, and Drive System Connected to ECU]

Next, sensors, switches, and a drive system connected to the ECU 71 will be described with reference to FIG. 7.

Figure 7:
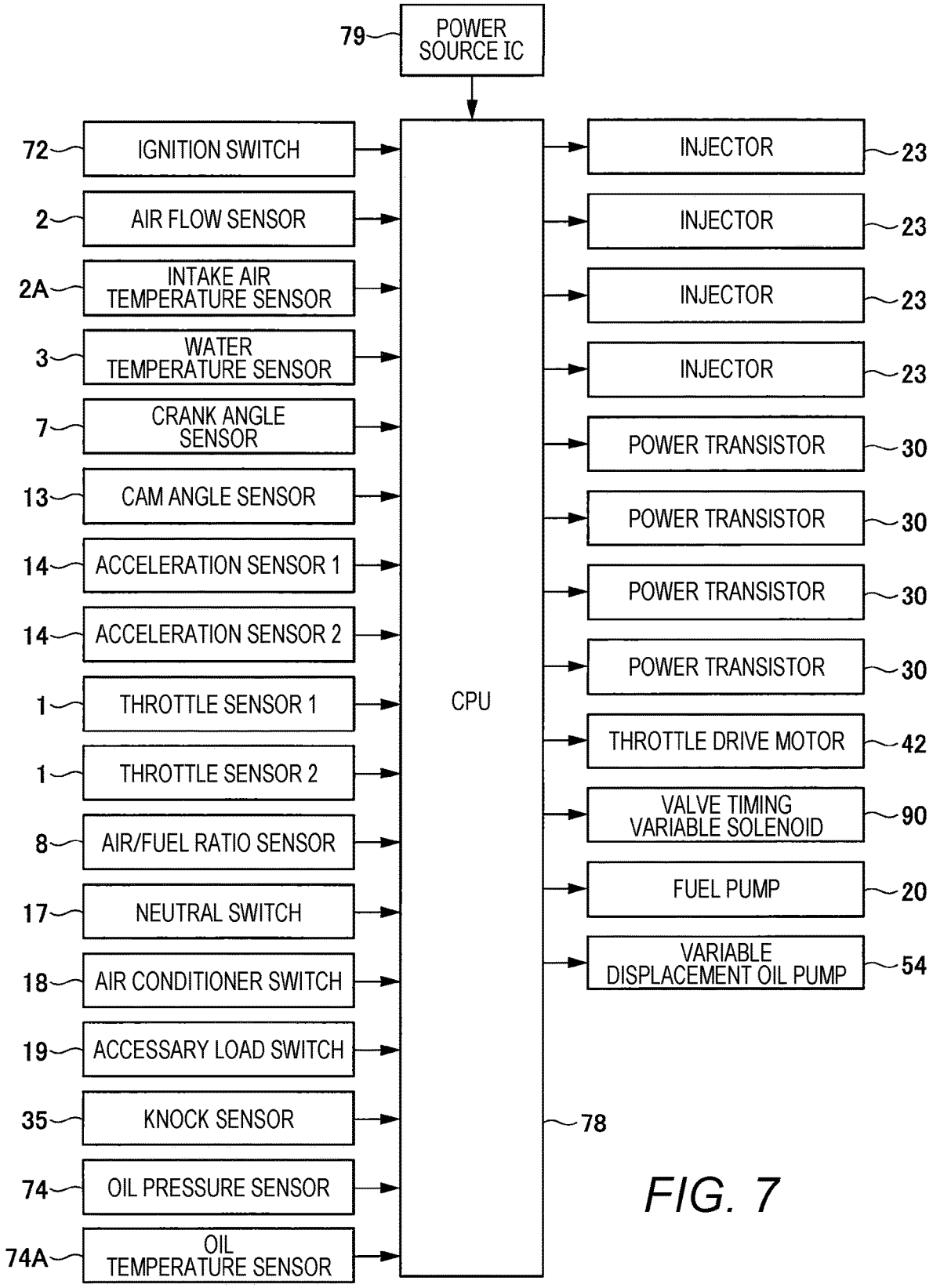
FIG. 7 is a block diagram illustrating sensors, switches, and a drive system that are connected to an ECU according to the embodiment 1.

FIG. 7 is a block diagram illustrating the sensors, the switches, and the drive system that are connected to the ECU 71.

As illustrated in FIG. 7, the ECU 71 includes a central processing unit (CPU) 78 and a power supply IC 79. Various functions of the ECU 71 are implemented as the CPU executes various processing programs stored in a ROM (not illustrated in the drawings).

The ECU 71 includes, for example, a fuel injection control unit that controls the injector 23, an ignition control unit that controls a power transistor 30, and the like. In addition, the ECU 71 includes: a hydraulic control unit that controls the variable displacement oil pump; and a determination unit that performs various determinations such as determination relating to clogging of a foreign matter in an oil pressure control valve (a hydraulic control valve) 171 described later.

To the CPU 78 of the ECU 71, signals from an ignition switch 72, the air flow sensor 2, the intake air temperature sensor 2A, the water temperature sensor 3, the crank angle sensor 7, a cam angle sensor 13, an acceleration degree-of-opening sensor 14, the throttle sensor 1, the air-fuel ratio sensor 8, the neutral switch 17, the air conditioner switch 18, an auxiliary load switch 19, the knock sensor 35, an oil pressure sensor 74, and an oil temperature sensor 74A are inputted.

Output signals outputted from the ECU 71 are supplied to the injector 23, a power transistor 30 including an ignition switch of the ignition plug 33 and the like, the throttle driving motor 42, a valve timing variable solenoid 90, the fuel pump 20, and the variable displacement oil pump 54.

The CPU 78 of the ECU 71 identifies knocking and noises other than knocking based on an output signal of the knock sensor 35. The vibrations of knocking are limited to a specific frequency. Accordingly, knocking and noises other than knocking can be distinguished based on the frequency of the output signal of the knock sensor 35. When knocking is identified, the CPU 78 performs a retardation control of ignition timing so as to suppress the occurrence of knocking. Then, the CPU 78 controls the electricity supply timing of the power transistor 30 based on target ignition timing when the retardation control is performed.

[Configuration of Variable Displacement Oil Pump]

Next, the configuration of the variable displacement oil pump 54 will be described with reference to FIG. 8.

Figure 8:
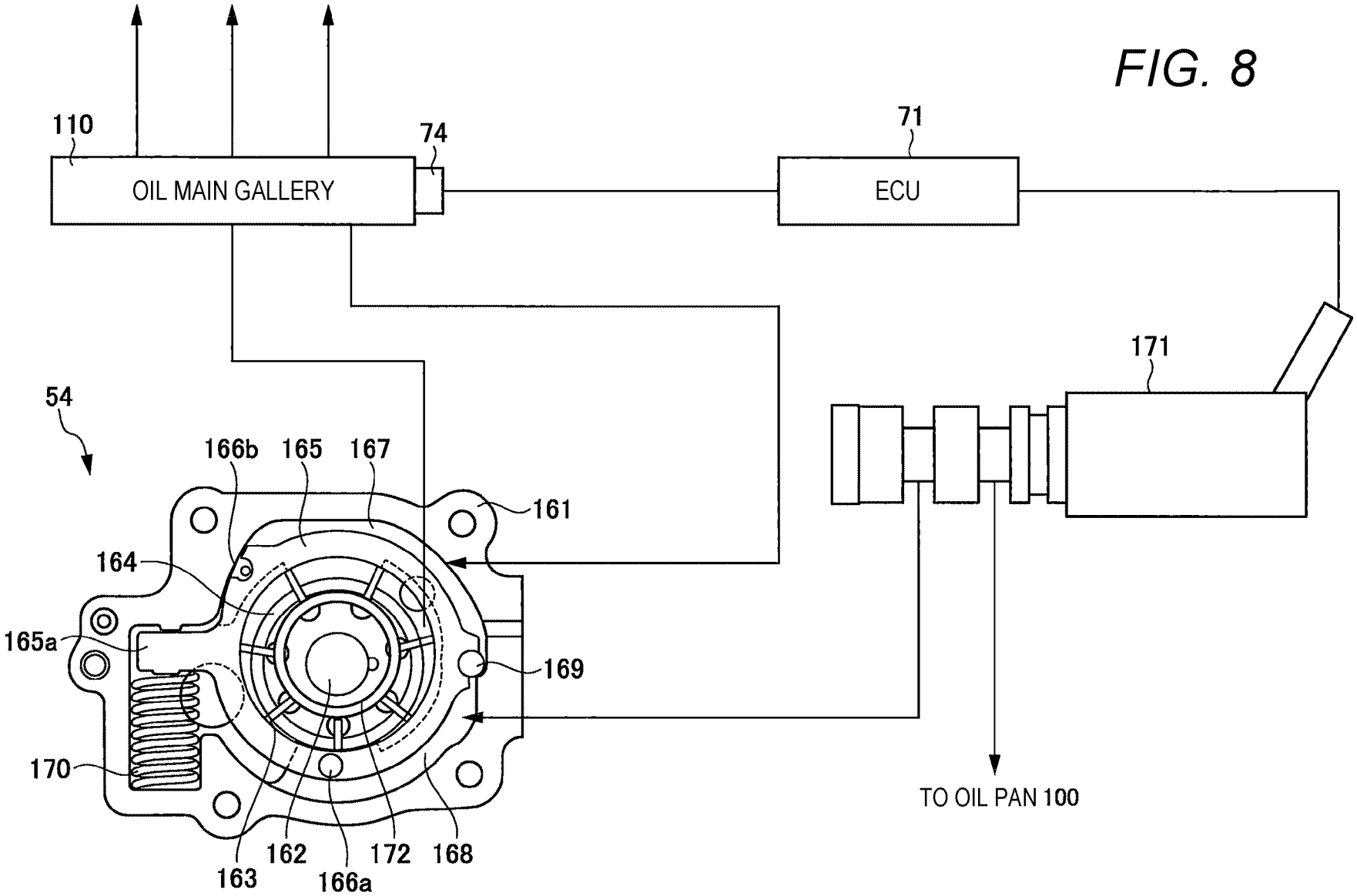
FIG. 8 is a cross-sectional view illustrating the configuration of a variable displacement oil pump according to an embodiment 1.

FIG. 8 is a cross-sectional view illustrating the configuration of the variable displacement oil pump 54.

As illustrated in FIG. 8, the variable displacement oil pump 54 includes: a housing 161 that is a hollow housing; a drive shaft 162 that penetrates the housing 161; a rotor 164 disposed in the housing 161; and a cam ring 165.

On a side portion of the housing 161, a suction port through which oil is sucked, and a discharge port through which oil is ejected are formed. The drive shaft 162 penetrates substantially the center of the housing 161. A rotational force is transmitted from the crankshaft 112 of the internal combustion engine 65 to the drive shaft 162.

The rotor 164 is coupled to the drive shaft 162. A plurality of vanes 163 that protrude toward an outer peripheral side are mounted on the rotor 164. The rotor 164 holds the plurality of vanes 163 in a state where the vanes 163 are advanceable and retractable in the substantially radial direction. The cam ring 165 is mounted on an outer peripheral side of the rotor 164 in a state where the cam ring 165 is eccentrically swingable. Distal ends of the respective vanes 163 are brought into slide contact with an inner peripheral surface of the cam ring 165. A pair of vane rings 172 is slidably disposed at both ends in the axial direction on an inner peripheral portion side of the rotor 164.

The cam ring 165 is configured to be swingable about a pivot pin 169. The cam ring 165 has a lever portion 165*a* that protrudes in a radial direction from the outer peripheral portion. The lever portion 165*a* is biased by a coil spring 170 disposed in the housing 161. The cam ring 165 forms operation chambers 167, 168 between the cam ring 165 and an inner peripheral surface of the housing 161. The operation chambers 167, 168 are separated from each other by seal members 166*a*, 166*b* disposed on an outer peripheral portion of the cam ring 165.

The cam ring 165 swings in a direction in which an eccentric amount is decreased according to a pressure of a lubricating oil introduced into the operation chambers 167, 168. In addition, the cam ring 165 swings in a direction in which the eccentric amount is increased by a spring force of the coil spring 170 that presses the lever portion 165*a*.

In an initial state of the variable displacement oil pump 54, the cam ring 165 is biased by a spring force of the coil spring 170, and is disposed at a position where the eccentric amount becomes maximized. With such a configuration, a discharge pressure of the variable displacement oil pump 54 is increased. When a pressure of a lubricating oil in the operation chambers 167, 168 becomes a predetermined value or more, the cam ring 165 swings in a direction in which the eccentric amount is decreased against a spring force of the coil spring 170. With such a configuration, a discharge pressure of the variable displacement oil pump 54 is decreased.

Lubricating oil is supplied from the main gallery 110 to the operation chamber 167 of the variable displacement oil pump 54. On the other hand, a lubricating oil is supplied to the operation chamber 168 through the oil control valve 171. A lubricating oil discharged from a discharge port of the variable displacement oil pump 54 is supplied to the above-described valve timing variable mechanism 91 of the internal combustion engine 65, an oil jet mechanism that cools the piston 122, and the like.

Figure 9:
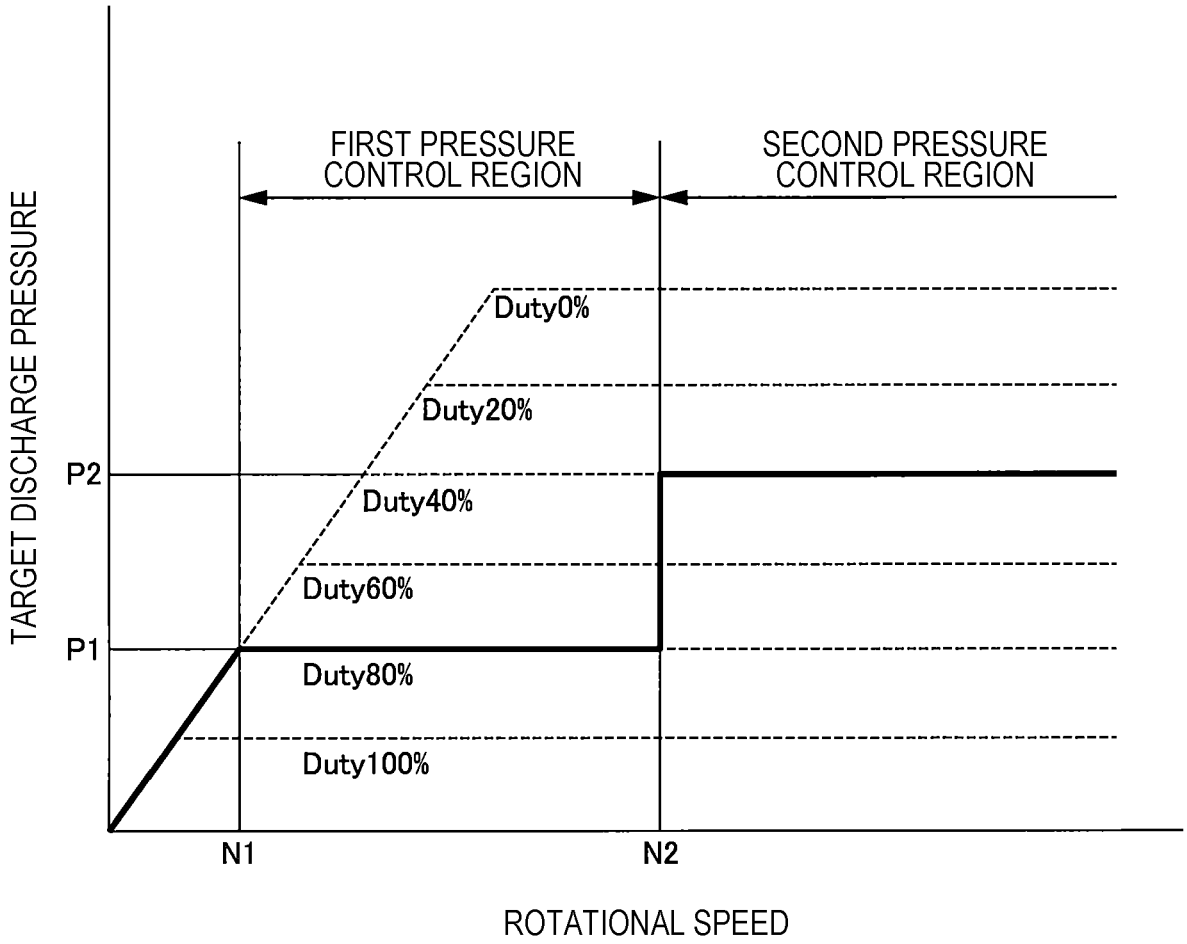
FIG. 9 is a graph for describing a target discharge pressure.

FIG. 9 is a graph for describing a target discharge pressure.

As illustrated in FIG. 9, the oil control valve 171 is subjected to a DUTY control corresponding to a rotational speed of the engine.

When the oil control valve 171 has a DUTY of 100%, the operation chamber 167 of the variable displacement oil pump 54 communicates with a drain (an oil pan 100) so that the operation chamber 167 is brought into a low pressure state. On the other hand, when the oil control valve 171 has a DUTY of 0%, an oil pressure is applied to the operation chamber 167 so that the operation chamber 167 is brought into a high pressure state. A discharge pressure of the variable displacement oil pump 54 is adjusted by a DUTY value adjusted between DUTY of 100% and DUTY of 0%.

A control signal (DUTY signal) is supplied from the ECU 71 (control device) to the oil control valve 171. Accordingly, an electromagnetic solenoid 184, which will be described later, of the oil control valve 171 is driven to the instructed control position. Further, at this point of time, a thrust force of a coil changes depending on a power supply voltage and hence, the thrust force is corrected using a power supply voltage characteristic correction value.

In the present embodiment, a target discharge pressure of the variable displacement oil pump 54 is set. Then, the oil control valve 171 is controlled so as to realize the set target discharge pressure. That is, the ECU 71 controls the oil control valve 171 so that an actual discharge pressure of the variable displacement oil pump 54 approaches a target discharge pressure.

In such a variable displacement oil pump 54, for example, the target discharge pressure is set corresponding to a rotational speed of the engine. As illustrated in FIG. 9, the target discharge pressure is set such that the larger a rotational speed, the larger the target discharge pressure becomes. The target discharge pressure is adjusted within a range from the minimum discharge pressure to the maximum discharge pressure within a range from a predetermined minimum rotational speed to a predetermined maximum rotational speed. A discharge pressure of a lubricating oil by the variable displacement oil pump 54 can be adjusted based on the DUTY ratio of a control signal supplied to the oil control valve 171 (see FIG. 8).

Accordingly, by making a DUTY ratio of a control signal and an engine rotational speed correspond to each other, the target discharge pressure of the variable displacement oil pump 54 is basically variably adjusted based on the rotational speed.

The variable displacement oil pump 54 can also be subjected to a feedforward control where the control is performed only based on a target discharge pressure without performing a feedback control that uses an actual discharge pressure.

[Structure of Hydraulic Control Valve]

Next, a structure of the oil control valve (hydraulic control valve) 171 is described with reference to FIG. 10.

Figure 10:
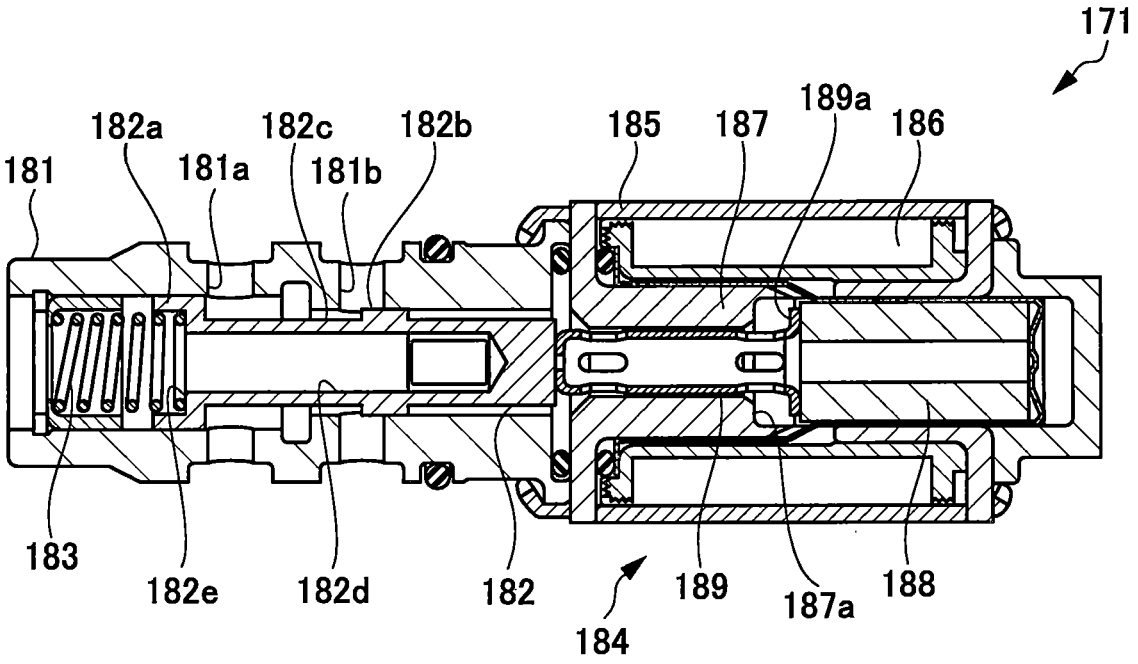
FIG. 10 is a cross-sectional view illustrating the structure of a hydraulic control valve according to the embodiment 1.

FIG. 10 is a cross-sectional view illustrating the structure of the hydraulic control valve.

As illustrated in FIG. 10, the oil control valve 171 includes a sleeve 181, a spool valve 182, a valve biasing spring 183, and an electromagnetic solenoid 184.

The sleeve 181 is formed in a substantially cylindrical shape. One end of the sleeve 181 in an axial direction is connected to the electromagnetic solenoid 184. Hereinafter, one end of the sleeve 181 in the axial direction is referred to as a proximal end, and the other end of the sleeve 181 in the axial direction is referred to as a distal end.

The sleeve 181 has oil introducing holes 181*a* and oil passing holes 181*b*. The oil introducing holes 181*a* and the oil passing holes 181*b* respectively extend in a radial direction of the sleeve 181 and penetrate the sleeve 181. The oil passing holes 181*b* are formed substantially at the center in the axial direction of the sleeve 181. The oil introducing holes 181*a* are formed on a more distal end side than the oil passing holes 181*b*.

The oil introducing holes 181*a* communicate with the main gallery 110 described above (see FIG. 1). On the other hand, the oil passing holes 181*b* communicate with the operation chamber 168 of the variable displacement oil pump 54.

The spool valve 182 is formed in a bottomed cylindrical shape having a bottom at one end of the spool valve 182 in the axial direction. Hereinafter, one end of the spool valve 182 in the axial direction is referred to as a proximal end, and the other end of the spool valve 182 in the axial direction is referred to as a distal end. The spool valve 182 is disposed in the sleeve 181. The spool valve 182 is movable in the axial direction by slidably moving on an inner peripheral surface of the sleeve 181.

The spool valve 182 includes a first land portion 182*a* and a second land portion 182*b*. The first land portion 182*a* is disposed on a more distal end side than the center of the spool valve 182 in the axial direction. The second land portion 182*b* is disposed on a more proximal end side than the center of the spool valve in the axial direction. The first land portion 182*a* and the second land portion 182*b* protrude in the radial direction from an outer peripheral surface of the spool valve 182. The first land portion 182*a* and the second land portion 182*b* slidably move on the inner peripheral surface of the sleeve 181.

An annular passage groove 182*c* that is an annular recessed portion is formed between the first land portion 182*a* and the second land portion 182*b*. In a case where the annular passage groove 182*c* faces the oil introducing holes 181*a* and the oil passing holes 181*b* formed in the sleeve 181, the oil introducing holes 181*a* and the oil passing holes 181*b* communicate with each other through the annular passage groove 182*c*.

On the other hand, when the spool valve 182 moves to a distal end side of the sleeve 181, the second land portion 182*b* is brought into contact with the inner peripheral surface between the oil introducing holes 181*a* and the oil passing holes 181*b* formed in the sleeve 181. With such a configuration, the annular passage groove 182*c* does not face the oil passing holes 181*b*. As a result, the oil introducing holes 181*a* and the oil passing holes 181*b* are isolated from each other.

An oil passage 182*d* through which oil flows is formed in the inside of the spool valve 182. The oil passage 182*d* communicates with a through holes (not illustrated) formed in the spool valve 182 on a more proximal end side than the second land portion 182*b*. Accordingly, in a case where an end surface of the second land portion 182*b* on a proximal end side faces the oil passing holes 181*b*, the oil passage 182*d* communicates with the oil passing holes 181*b* through the through holes (not illustrated). The oil that passes through the oil passage 182*d* is discharged from a distal end of the spool valve 182 to the outside, and is collected by the oil pan 100.

The valve biasing spring 183 is disposed in the sleeve 181 on the distal end side. The valve biasing spring 183 is, for example, a compression coil spring. One end of the valve biasing spring 183 is brought into contact with a stepped surface 182*e* formed on the distal end potion of the spool valve 182. The other end of the valve biasing spring 183 is brought into contact with a spring stopper 181*c* mounted on the sleeve 181. The valve biasing spring 183 biases the spool valve 182 toward an electromagnetic solenoid 184 side.

The electromagnetic solenoid 184 includes a solenoid casing 185, an electromagnetic coil 186, a fixed yoke 187, a movable plunger 188, and a rod 189.

The solenoid casing 185 is formed in a cylindrical shape. The electromagnetic coil 186 is disposed in the solenoid casing 185. The electromagnetic coil 186 is electrically connected to the ECU 71 via a terminal (not illustrated in the drawing). A control current that is outputted from the ECU 71 flows through the electromagnetic coil 186.

The fixed yoke 187 is fixed to the solenoid casing 185. The fixed yoke 187 is formed in a substantially cylindrical shape, and a stepped surface 187*a* is formed on an inner peripheral side of the fixed yoke 187. An outer peripheral side of the fixed yoke 187 faces an inner peripheral side of the electromagnetic coil 186. The movable plunger 188 is formed in a substantially cylindrical shape. The movable plunger 188 is accommodated in the solenoid casing 185 in a state where the movable plunger 188 is movable in the axial direction. One end of the movable plunger 188 in the axial direction faces the stepped surface 187*a* of the fixed yoke 187.

The rod 189 is formed in a bottomed cylindrical shape such that the rod 189 has a bottom at one end thereof in the axial direction. A flange 189*a* that protrudes outward in the radial direction is formed on the other end of the rod 189 in the axial direction. The flange 189*a* of the rod 189 is brought into contact with one end of the movable plunger 188 in the axial direction. That is, the flange 189*a* is interposed between one end of the movable plunger 188 and the stepped surface 187*a* of the fixed yoke 187.

One end of the rod 189 in the axial direction protrudes from one end of the fixed yoke 187 in the axial direction, and abuts on a proximal end of the spool valve 182. In a non-energized state where no control current flows through the electromagnetic coil 186, the rod 189 is biased by a spring force of the valve biasing spring 183 by way of the spool valve 182. At this stage of the operation, the spool valve 182 is disposed at an initial position.

When the spool valve 182 is disposed at the initial position, the annular passage groove 182*c* of the spool valve 182 faces the oil introducing holes 181*a* and the oil passing holes 181*b* formed in the sleeve 181. As a result, the oil introducing holes 181*a* and the oil passing holes 181*b* communicate with each other through the annular passage groove 182*c*.

When a control current flows into the electromagnetic coil 186, a magnetic attractive force is generated between one end of the movable plunger 188 and the stepped surface 187*a* of the fixed yoke 187. Accordingly, the movable plunger 188 is attracted by the fixed yoke 187 so that the movable plunger 188 moves in a direction approaching the stepped surface of the fixed yoke 187. Then, the rod 189 that abuts on the movable plunger 188 presses the spool valve 182 toward a distal end side of the sleeve 181 against a spring force of the valve biasing spring 183. As a result, the spool valve 182 moves to the distal end side of the sleeve 181.

When the spool valve 182 moves from the initial position to the distal end side of the sleeve 181, the annular passage groove 182*c* of the spool valve 182 does not face the oil passing holes 181*b*. Accordingly, the oil introducing holes 181*a* and the oil passing holes 181*b* are isolated from each other. As a result, the oil that passes through the oil introducing hole 181*a* cannot pass through the oil passing hole 181*b* and hence, the oil cannot reach the operation chamber 168 of the variable displacement oil pump 54.

[Operation of Variable Displacement Oil Pump]

Next, the operation of the variable displacement oil pump 54 is described with reference to FIG. 11 and FIG. 12.

Figure 11:
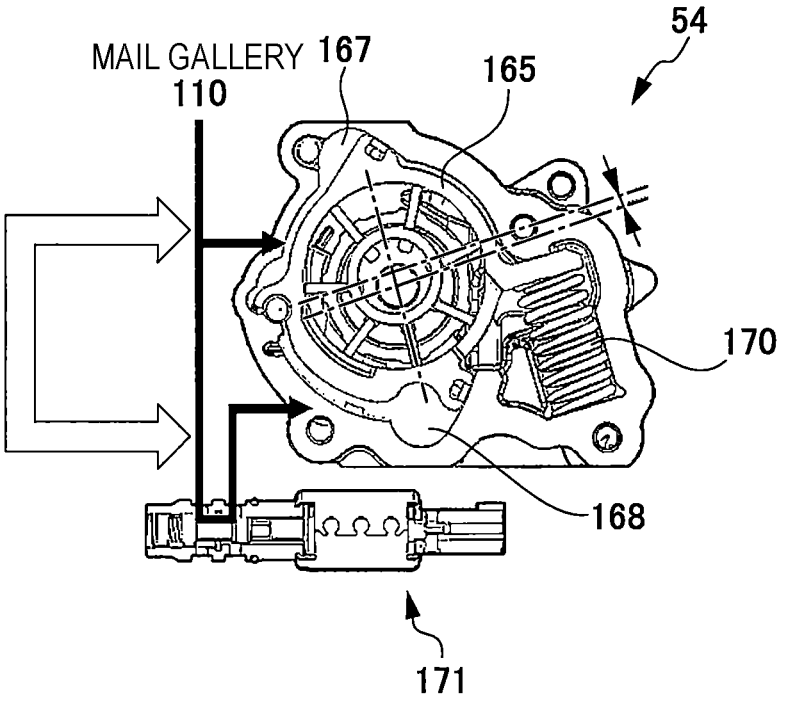
FIG. 11 is a view illustrating the variable displacement oil pump according to the embodiment 1 in a case where a discharge amount of the variable displacement oil pump is maximum.

FIG. 11 is a view illustrating a case where a displacement of the variable displacement oil pump 54 is maximum. FIG. 12 is a view illustrating a case where the displacement of the variable displacement oil pump 54 is minimum.

As illustrated in FIG. 11, when the oil control valve 171 is driven at the minimum DUTY, the oil introducing holes 181*a* and the oil passing holes 181*b* described above communicate with each other through the annular passage groove 182*c*. Accordingly, the oil flows into the operation chamber 168 of the variable displacement oil pump 54, and an amount of eccentricity of the cam ring 165 becomes maximum. As a result, the displacement of the variable displacement oil pump 54 becomes maximum.

Figure 12:
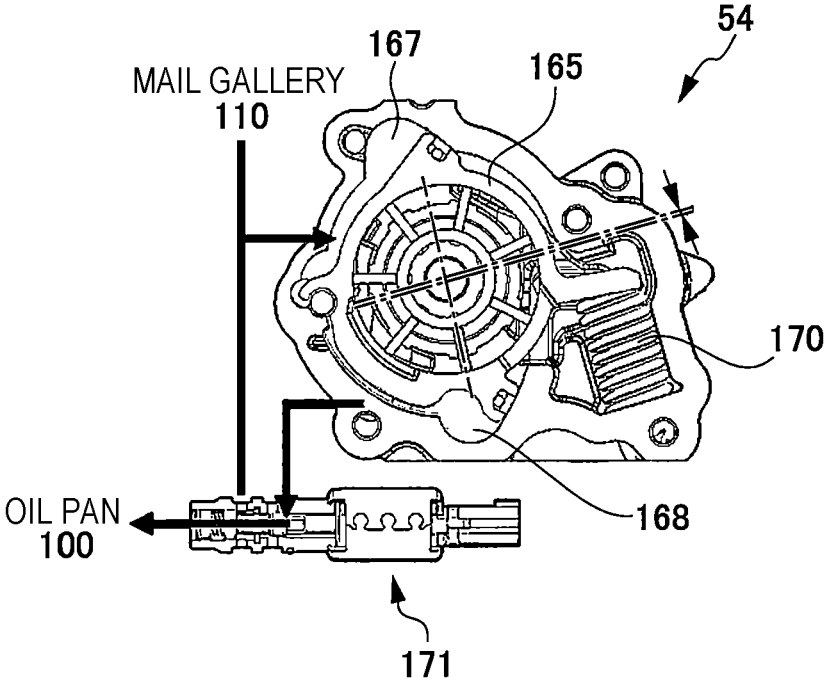
FIG. 12 is a view illustrating the variable displacement oil pump according to the embodiment 1 in a case where a discharge amount of the variable displacement oil pump is minimum.

As illustrated in FIG. 12, when the oil control valve 171 is driven at the large DUTY, the oil introducing holes 181*a* and the oil passing holes 181*b* described above do not communicate with each other through the annular passage groove 182*c*. Accordingly, the oil in the operation chamber 168 of the variable displacement oil pump 54 is discharged to the oil pan 100, and an amount of eccentricity of the cam ring 165 becomes minimum. As a result, the displacement of the variable displacement oil pump 54 becomes minimum.

Further, the spool valve 182 of the oil control valve 171 moves not only by a thrust force generated by the electromagnetic solenoid 184 but also by a thrust force generated by an oil pressure. That is, when the oil pressure of the oil that flows through the oil control valve 171 is high, a thrust force acts in the same direction as when a drive current supplied to the electromagnetic solenoid 184 is increased.

Accordingly, the oil control valve 171 has a mechanical feedback characteristic where the oil control valve 171 is operated so as to reduce the displacement of the variable displacement oil pump 54 so as to lower the oil pressure when the oil reaches a predetermined pressure. With such an operation, it is possible to determine whether the flow passage of the oil takes the case illustrated in FIG. 11 or the case illustrated in FIG. 12 depending on the oil pressure. From the above, it is understood that when a foreign matter is sandwiched between the spool valve 182 and the sleeve 181, the position at which the foreign matter is sandwiched differs depending on the oil pressure at this point of time.

[Occurrence Pattern of Clogging of a Foreign Matter]

Next, a clogging of a foreign matter occurrence pattern in the oil control valve 171 is described with reference to FIG. 13 and FIG. 14.

Figure 13:
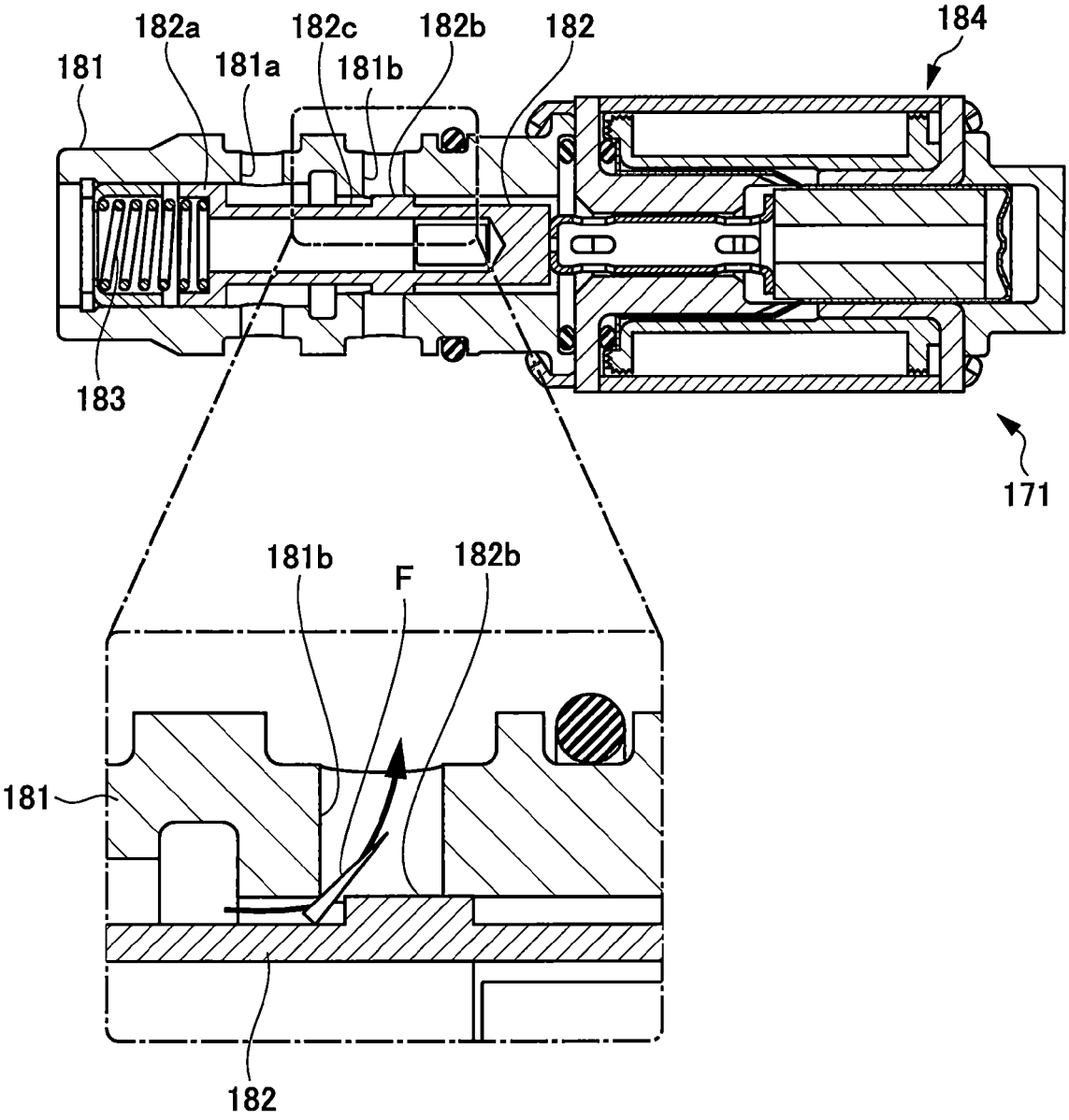
FIG. 13 is a view illustrating a first example when a clogging of a foreign matter occurs between a sleeve and a spool valve of a hydraulic control valve according to the embodiment 1.

FIG. 13 is a view illustrating a first example where a clogging of a foreign matter occurs between the sleeve 181 and the spool valve 182. FIG. 14 is a view illustrating a second example where a clogging of a foreign matter occurs between the sleeve 181 and the spool valve 182.

FIG. 13 illustrates a state of the oil control valve 171 before the internal combustion engine 65 starts its operation. As illustrated in FIG. 13, the spool valve 182 of the oil control valve 171 is disposed at the initial position by being biased by the valve biasing spring 183. When the internal combustion engine 65 is started from this state, the cam ring 165 of the variable displacement oil pump 54 swings due to cranking and hence, the circulation of oil starts. However, an oil pressure is low, and the electromagnetic solenoid 184 is not energized.

Accordingly, a passage through which the oil passes is formed between the edge portions of the oil passing holes 181*b* on a valve biasing spring 183 side (a distal end side of the sleeve 181) in the sleeve 181 and a second land portion 182*b* of the spool valve 182. As a result, there is a case where a foreign matter F is clogged between the edge portions of the oil passing hole 181*b* of the sleeve 181 on the valve biasing spring 183 side and the second land portion 182*b* of the spool valve 182. Hereinafter, the edge portion of the oil passing hole 181*b* on the valve biasing spring 183 side is referred to as "the distal end side edge portion of the oil passing hole 181*b*". In this embodiment, assuming a state where the foreign matter F is clogged between the distal end side edge portion of the oil passing hole 181*b* and the second land portion 182*b* of the spool valve 182 as lock pattern 1.

In a case where the lock pattern 1 occurs, the foreign matter F becomes an obstacle to prevent the movement of the spool valve 182 toward a distal end side of the sleeve 181. Accordingly, a state where the oil introducing holes 181*a* and the oil passing holes 181*b* communicate with each other is maintained and hence, a function of lowering the oil pressure by the oil control valve 171 does not work. That is, in a case where the lock pattern 1 occurs, when an engine rotational speed after starting is increased so that the oil pressure is increased, a state is brought about where the oil pressure cannot be lowered.

In a case where the lock pattern 1 occurs, a cleaning A control or a cleaning C control for discharging a foreign matter F is performed. The cleaning A control is a cleaning control provided by assuming that the foreign matter F is caught by the spool valve 182. The cleaning C control is a cleaning control performed by assuming that a foreign matter F bites into the spool valve 182 or the distal end side edge portion of the oil passing hole 181*b*.

In the cleaning A control performed for the lock pattern 1, the spool valve 182 is vibrated while increasing an opening area of the oil passing holes 181*b* by moving the spool valve 182 toward the proximal end side of the sleeve 181. At this stage of the operation, to enable the vibrations to be properly transmitted to the distal end side edge portion of the oil passing holes 181*b*, a control current of a relatively small DUTY is supplied to the electromagnetic solenoid 184. Accordingly, the foreign matter that is caught by the spool valve 182 is separated from the spool valve 182 and is discharged.

The reduction of an engine rotational speed may be performed in combination with the cleaning A control. With such an operation, an oil pressure in the main gallery 110 is lowered and hence, an oil pressure (a thrust force) that moves the spool valve 182 toward the distal end side of the sleeve 181 is weakened. As a result, the foreign matter F can be easily discharged.

In the cleaning C control performed for the lock pattern 1, the foreign matter F is scraped off from the spool valve 182 and the distal end side edge portions of the oil passing holes 181*b* by moving the spool valve 182 toward the distal end side of the sleeve 181. At this point of time, a control current of a relatively large DUTY is supplied to the electromagnetic solenoid 184. Accordingly, the foreign matter F is scraped off, and is separated and discharged from the spool valve 182 and the distal end side edge portions of the oil passing holes 181*b*.

Figure 14:
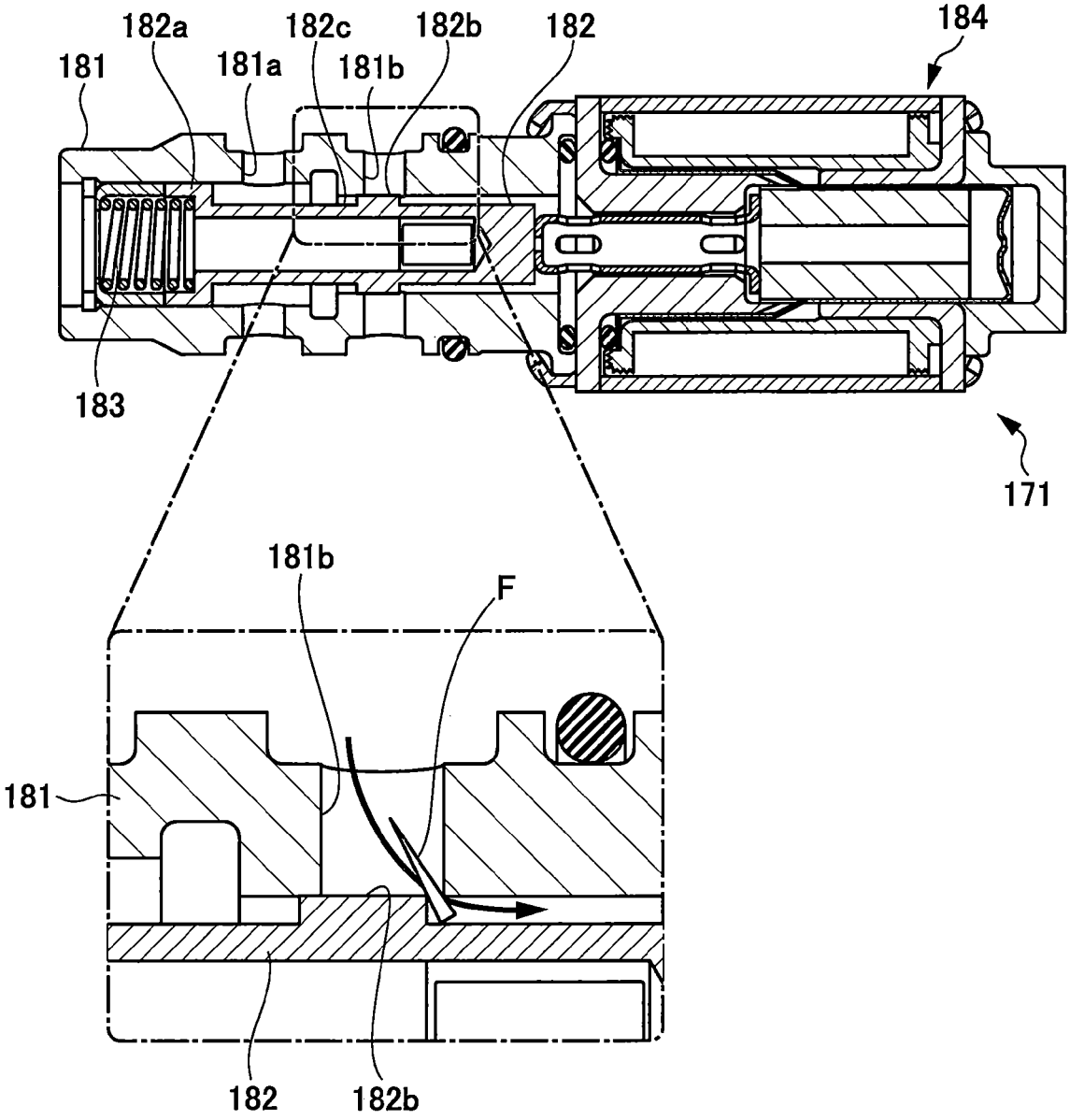
FIG. 14 is a view illustrating a second example when a clogging of a foreign matter occurs between the sleeve and the spool valve of the hydraulic control valve according to the embodiment 1.

FIG. 14 illustrates a state where a discharge capability of the variable displacement oil pump 54 is high, and the oil control valve 171 is controlled so as to lower an oil pressure. As illustrated in FIG. 14, the spool valve 182 of the oil control valve 171 is displaced toward the distal end side of the sleeve 181 against a biasing force of the valve biasing spring 183 by oil pressure or an attraction force of the solenoid.

At this stage of operation, a passage through which oil passes is formed between an edge portion of the oil passing hole 181*b* on a side opposite to the valve biasing spring 183 (a proximal end side of the sleeve 181) and the second land portion 182*b* of the spool valve 182. As a result, there may be a case where the foreign matter F is clogged between the edge portion of the oil passing hole 181*b* on a side opposite to the valve biasing spring 183 and the second land portion 182*b* of the spool valve 182. Hereinafter, the edge portion of the oil passing hole 181*b* on a side opposite to the valve biasing spring 183 is referred to as "the proximal end side edge portion of the oil passing hole 181*b*". Then, a state where the foreign matter F is clogged between the proximal end side edge portion of the oil passing hole 181*b* and the second land portion 182*b* of the spool valve 182 is referred to as a lock pattern 2.

In a case where the lock pattern 2 occurs, the foreign matter F becomes an obstacle to prevent the movement of the spool valve 182 toward a proximal end side of the sleeve 181. Accordingly, the oil introducing hole 181*a* and the oil passing holes 181*b* do not communicate with each other and hence, a function of elevating oil pressure by the oil control valve 171 does not work. Accordingly, in a case where the lock pattern 2 occurs, a state is brought about where an oil pressure is not increased even when an engine rotational speed is increased after starting the engine.

In a case where the lock pattern 2 occurs, the cleaning A control or a cleaning B control for discharging a foreign matter F is performed. The cleaning A control is a cleaning control provided by assuming that the foreign matter F is caught by the spool valve 182. The cleaning B control is a cleaning control provided by assuming that the foreign matter F adheres to the spool valve 182 or the proximal end side edge portion of the oil passing hole 181*b*.

In the cleaning A control performed for the lock pattern 2, the spool valve 182 is moved toward the distal end side of the sleeve 181, and the spool valve 182 is vibrated while in a state where an opening area of the oil passing holes 181*b* is increased. At this stage of the operation, to enable the vibrations to be properly transmitted to the proximal end side edge portion of the oil passing holes 181*b*, a control current of a relatively small DUTY is supplied to the electromagnetic solenoid 184. Accordingly, the foreign matter that is caught by the spool valve 182 is separated from the spool valve 182 and is discharged.

In the cleaning B control performed for the lock pattern 2, the spool valve 182 is moved toward the distal end side of the sleeve 181 so as to scrape off a foreign matter F from the spool valve 182 and from the distal end side edge portions of the oil passing holes 181*b*. At this point of time, a control current of a relatively large DUTY is supplied to the electromagnetic solenoid 184. Accordingly, the foreign matter F is scraped off from the spool valve 182 and the distal end side edge portions of the oil passing holes 181*b* and is discharged.

[Control Function of Variable Displacement Oil Pump]

Next, functions of the ECU 71 that controls the variable displacement oil pump 54 are described with reference to FIG. 15.

Figure 15:
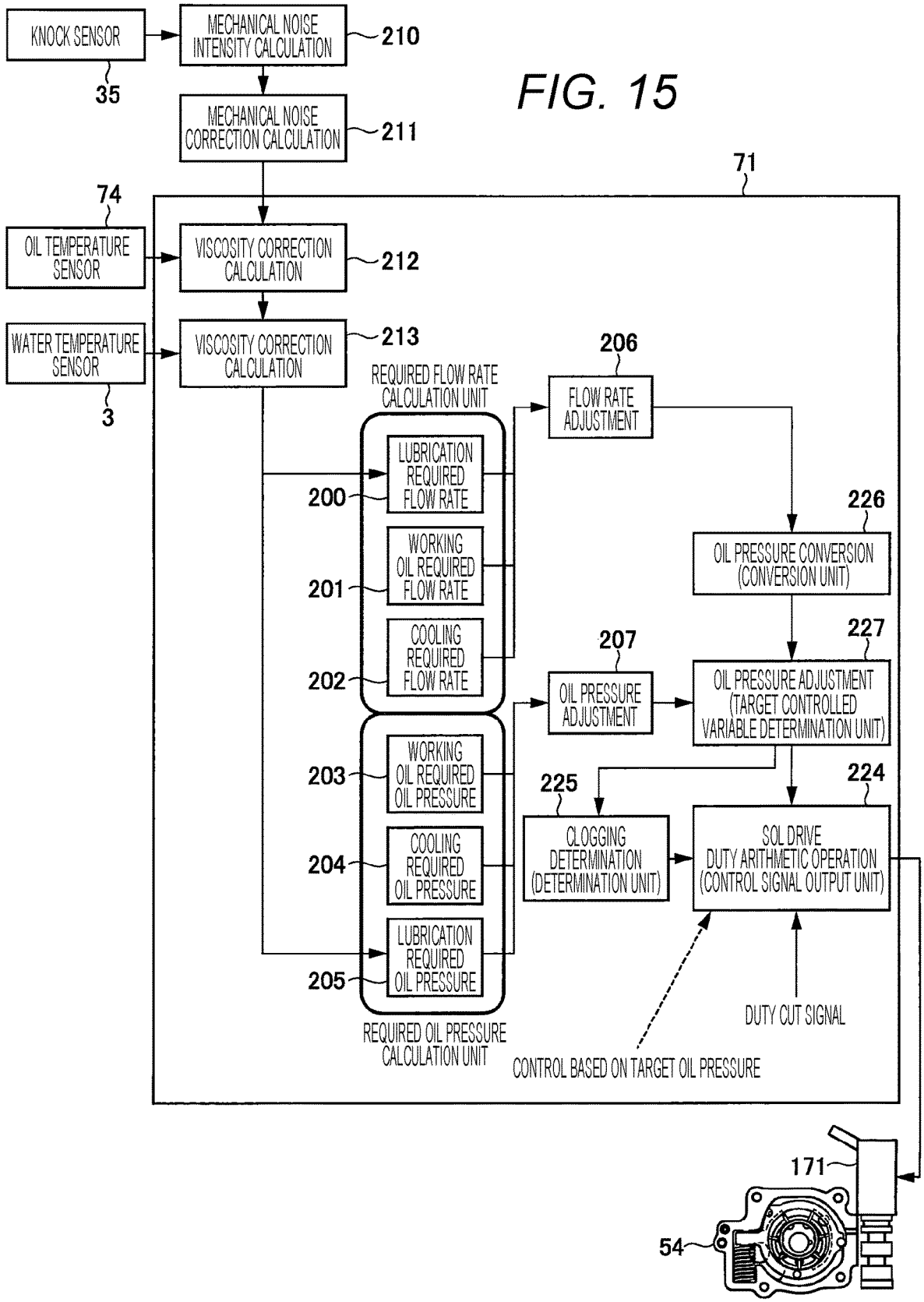
FIG. 15 is a block diagram illustrating a function of an ECU according to the embodiment 1.

FIG. 15 is a block diagram illustrating functions of the ECU 71.

As illustrated in FIG. 15, the ECU 71 includes: a required flow rate calculation unit that calculates a required flow rate (a lubrication required flow rate 200; a working oil required flow rate 201; a cooling required flow rate 202) for each oil supply portion; and a required oil pressure calculation unit that calculates a required oil pressure (a working oil required oil pressure 203, a cooling required oil pressure 204, a lubrication required oil pressure 205) for each oil supply portion.

The ECU 71 includes: a flow rate adjusting unit 206; and an oil pressure adjusting unit 207. The flow rate adjusting unit 206 outputs a flow rate selected from among the required flow rates for every oil supply portion, or an additional value of the required flow rate for every oil supply portion. The oil pressure adjusting unit 207 outputs a maximum value of a required oil pressure for each oil supply portion.

The ECU 71 further includes: a conversion unit 226; and a target controlled variable determination unit 227. The conversion unit 226 converts an output value of the flow rate adjusting unit 206 into an oil pressure and outputs the oil pressure. The target controlled variable determination unit 227 determines a target oil pressure based on an output value of the oil pressure adjusting unit 207 and an output value of the conversion unit 226.

The ECU 71 further includes: a control signal outputting unit 224; and a determination unit 225. The control signal outputting unit 224 calculates and outputs a control signal of the oil control valve 171 corresponding to a target oil pressure. The determination unit 225 determines clogging of a foreign matter and the position where clogging of a foreign matter has occurred based on a target oil pressure and an actual oil pressure that is detected by the oil pressure sensor 74. In this manner, the ECU 71 integrates the control based on a target discharge flow rate and the control based on a target oil pressure into the control based on a target discharge flow rate.

In the present embodiment, a mechanical noise correction calculation 211 is performed based on viscosity of oil estimated by the mechanical noise intensity calculation 210 of the engine. The viscosity correction calculation 212 is performed based on viscosity of oil obtained based on a temperature of oil, and the viscosity correction calculation 213 is performed based on viscosity oil obtained from a temperature of water. Then, the ECU 71 corrects various required flow rates and various required oil pressures by combining calculation results of the mechanical noise correction calculation 211, the viscosity correction calculation 212, and the viscosity correction calculation 213.

The required flow rate calculation unit of the present embodiment performs the correction such that the smaller the viscosity of oil becomes, the larger the required flow rate becomes. Further, the required flow rate calculation unit performs the correction such that the smaller the viscosity of oil, the larger the required oil pressure becomes. As a result, the required flow rate calculation unit corrects the required flow rate and the required oil pressure corresponding to the viscosity of the oil. As a result, the accuracy of the control of the variable displacement oil pump 54 can be enhanced.

A lubrication required flow rate 200 is determined based on a rotational speed of the engine. A working oil required flow rate 201 is determined in consideration of a volume and a displacement of an actuator and time. A cooling required flow rate 202 is determined corresponding to a difference between an oil temperature and a cooling water temperature. In the present embodiment, a cooling capacity is maintained in such a manner that the smaller a temperature difference, the larger a required flow rate is increased.

A working oil required oil pressure 203 is determined based on an inertia of an actuator and a required shift speed. A cooling required oil pressure 204 is determined in consideration of a resistance of oil piping. A lubrication required oil pressure 205 is determined based on a predetermined table or the like.

[Control Processing of Hydraulic Control Valve]

Next, control processing of the oil control valve (the hydraulic control valve) 171 is described with reference to FIG. 16.

Figure 16:
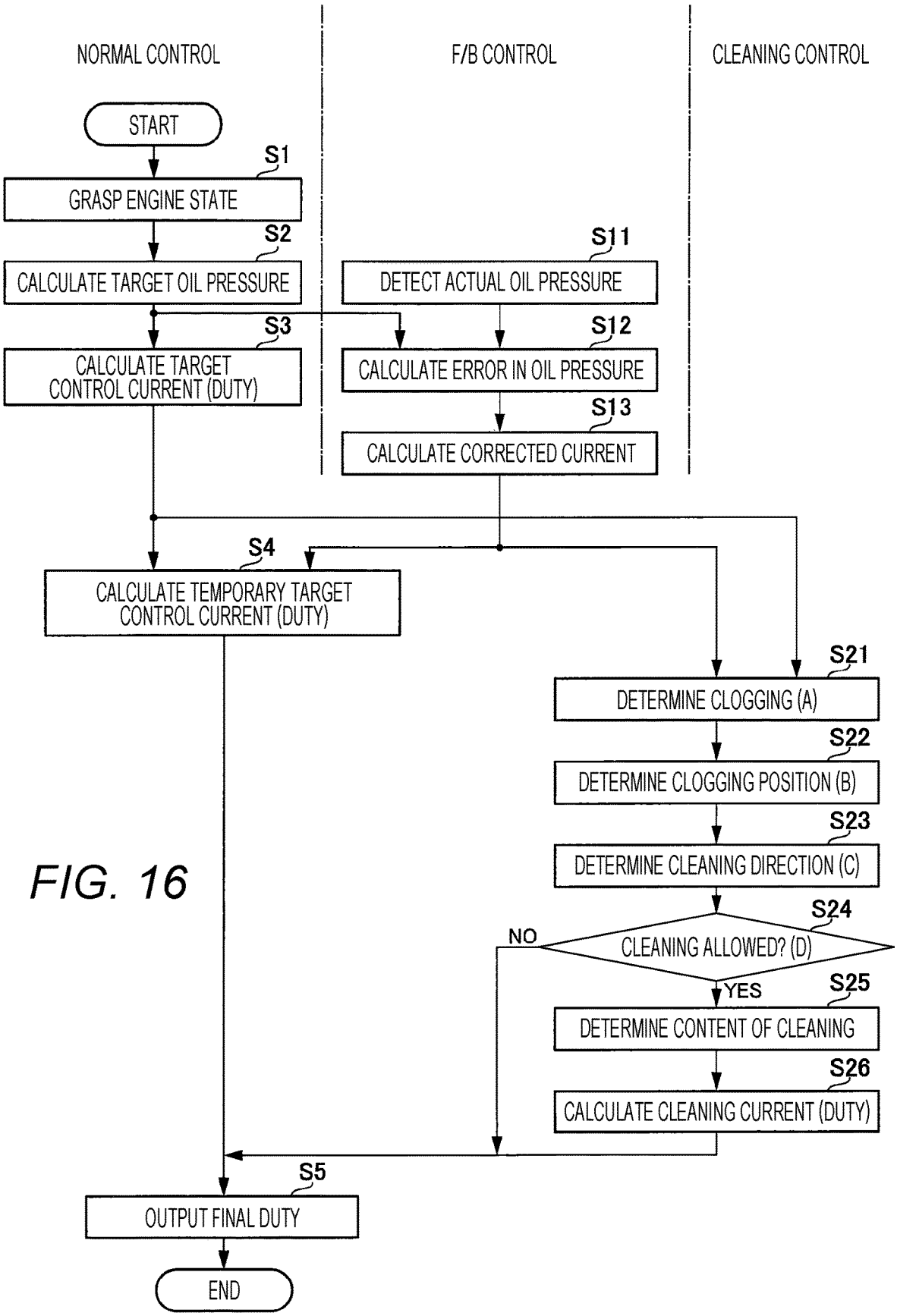
FIG. 16 is a flowchart illustrating control processing of the hydraulic control valve performed by the ECU according to the embodiment 1.

FIG. 16 is a flowchart illustrating control processing of the hydraulic control valve.

First, in a normal control of the oil control valve 171, the ECU 71 grasps the state of the engine such as a rotational speed (S1). Next, the ECU 71 calculates a target oil pressure according to the state of the engine (S2). Next, the ECU 71 calculates a target control current (DUTY) to be outputted to the oil control valve 171 based on the displacement of the variable displacement oil pump 54 capable of realizing a target oi pressure (S3).

Next, the ECU 71 adds a correction current calculated in an oil pressure feedback control to the target control current thus calculating a provisional target control current (DUTY) (S4). Then, in a case where the occurrence of the clogging of a foreign matter is not determined, the ECU 71 determines the provisional target control current (DUTY) calculated in step S4 as a final control current (final DUTY). Then, the ECU 71 outputs the final control current (final DUTY) to the electromagnetic solenoid 184 of the oil control valve 171 (see FIG. 10) (S5).

Next, an oil pressure feedback control for correcting the deviation of the target oil pressure will be described.

In the oil pressure feedback control, the ECU 71 acquires an actual oil pressure detected by the oil pressure sensor 74 (S11). Next, a difference between an actual oil pressure and a target oil pressure is calculated as an oil pressure error (S12). Then, the ECU 71 calculates a correction current (DUTY) based on the oil pressure error calculated in step S12 (S13).

Next, the cleaning control performed corresponding to a correction current value is described. In the cleaning control, the ECU 71 determines whether or not clogging of a foreign matter exists in the oil control valve 171 (S21).

In step S21, the ECU 71 determines that clogging of a foreign matter exists when a correction current value calculated based on an oil pressure error (hereinafter, also referred to as an "oil pressure feedback correction value" is larger than a predetermined determination threshold. On the other hand, when the correction current value is equal to or less than the determination threshold, it is determined that the clogging of a foreign matter does not exist. The determination of threshold is described later in detail.

In the processing in step S21, in a case where it is determined that the clogging of a foreign matter does not exist, the ECU 71 decides a provisional target control current (DUTY) calculated in step S4 as a final control current (final DUTY). Then, the ECU 71 outputs the decided final control current (final DUTY) to the electromagnetic solenoid 184 of the oil control valve 171 (see FIG. 10).

When the ECU 71 determines in step S21 that a clogging of a foreign matter exists, the ECU 71 performs a clogging position determination (S22). The position where a clogging of a foreign matter occurs can be determined based on a correction current value calculated based on the oil pressure error. In the processing in step S22, the ECU 71 determines whether clogging is the pattern either in the lock pattern 1 or in the lock pattern 2 described above.

Next, the ECU 71 decides the cleaning direction corresponding to the position where the clogging of a foreign matter has occurred (S23). The cleaning direction is the direction along which the spool valve 182 is moved at the time of cleaning the oil control valve 171.

Next, the ECU 71 determines whether cleaning is to be allowed (S24). The ECU 71 determines whether or not cleaning is allowed in consideration of the cleaning direction and the state of the engine. The determination whether the cleaning is to be allowed may be made after the decision of the content of cleaning described later is made.

In a case where it is determined in step S24 that cleaning is not allowed (NO in S24), the ECU 71 determines a provisional target control current (DUTY) calculated in step S4 as a final control current (final DUTY), and outputs the final control current (final DUTY) to the electromagnetic solenoid 184 of the oil control valve 171 (see FIG. 10).

On the other hand, when it is determined in step S24 that the cleaning is allowed (YES in S24), the ECU 71 determines the content of the cleaning corresponding to the position where the clogging of a foreign matter occurs (S25). The ECU 71 decides any one of the cleaning A control, the cleaning B control, and the cleaning C control described above.

Next, the ECU 71 calculates a cleaning current (DUTY) corresponding to the content of the cleaning decided in step S25 (S26). Then, the ECU 71 decides the cleaning current (DUTY) calculated in step S26 as the final control current (final DUTY). Then, the ECU 71 outputs the final control current (final DUTY) to the electromagnetic solenoid 184 of the oil control valve 171 (see FIG. 10). As a result, it is possible to realize an optimal cleaning control that conforms to a state of a foreign matter.

[Light Clogging Determination Processing]

Next, the light clogging determination processing that the ECU 71 performs is described with reference to FIG. 17.

Figure 17:
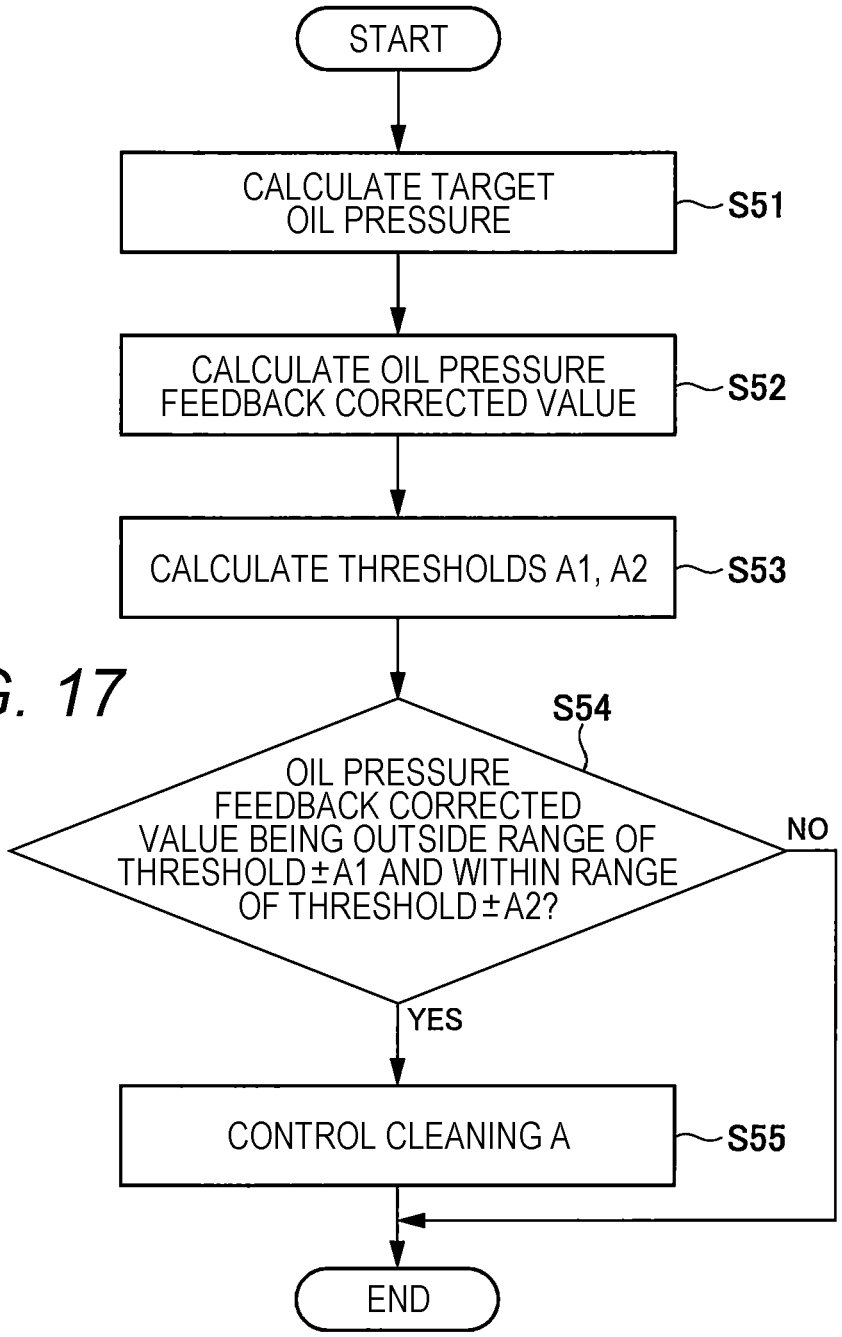
FIG. 17 is a flowchart illustrating a slight clogging determination processing performed by the ECU according to the embodiment 1.

FIG. 17 is a flowchart illustrating light clogging determination processing.

First, the ECU 71 calculates a target oil pressure (S51). Next, the ECU 71 calculates an oil pressure feedback correction value (a correction current) based on a difference between a target oil pressure and an actual oil pressure (S52).

Next, the ECU 71 calculates a light clogging determination lower limit threshold A1 (hereinafter, referred to as "threshold A1") and a light clogging determination upper limit threshold A2 (hereinafter, referred to as "threshold A2") (S53). Hereinafter, a range between the threshold A1 and the threshold −A1 is defined as a range of a threshold ±A1, and a range between the threshold A2 and the threshold −A2 is defined as a range of a threshold ±A2. The threshold A1 is a value for determining that a state is not conceivable when normal parts are used. The threshold A1 is determined by adding a margin value to an upper limit of a range of an oil pressure feedback correction value that takes into account irregularities in characteristic of the component in a normal state and characteristics in disturbance of a temperature and a voltage. On the other hand, the threshold A2 is larger than the threshold A1. The threshold A2 is a value that determines that the clogging is a slight abnormality and the degree of confinement of the spool valve 182 is small. In a state where the degree of confinement of the spool valve 182 is low, a feedback control of the spool valve 182 can be performed to some extent.

Next, the ECU 71 determines whether or not the oil pressure feedback correction value calculated in step S52 is outside the range of the threshold ±A1 and within the range of the threshold ±A2 (S54).

In step S54, in a case where the ECU 71 determines that the oil pressure feedback correction value is outside the range of the threshold ±A1 and not within the range of the threshold ±A2 (NO determination in S54), the ECU 71 finishes the light clogging determination processing. Accordingly, the ECU 71 determines that the clogging is not slight clogging. In a case where the oil pressure feedback correction value is within the range of ±A1, the ECU 71 determines that no clogging of a foreign matter has occurred.

In step S54, in a case where the ECU 71 determines that the oil pressure feedback correction value is outside the range of the threshold ±A1 and within the range of the threshold ±A2 (YES determination in S54), the ECU 71 determines that light clogging of a foreign matter has occurred and decides the cleaning A control as the content of the cleaning (S55). Then, the ECU 71 finishes the light clogging determination processing. In the present embodiment, in a case where the oil pressure feedback correction value is outside the range of the threshold ±A1 even if the cleaning A control is performed, the first severe clogging determination processing described later is performed.

In the control device for the hydraulic control valve according to the present invention, in a case where the ECU 71 determines that the clogging is the slight clogging in the slight clogging determination processing, the ECU may provisionally determine the slight clogging, and may perform the first severe clogging determination processing and the second severe clogging determination processing described later. In this case, when the ECU 71 determines that the clogging is neither the first severe clogging nor the second severe clogging, the ECU 71 formally determines the clogging as the slight clogging.

With respect to the state of clogging of a foreign matter when CPU 71 determines that the clogging of a foreign matter is the slight clogging, the state is determined that a foreign matter is caught by the spool valve 182. When the ECU 71 determines that the clogging of a foreign matter is the slight clogging, the case where the position of the clogging of a foreign matter is in the lock pattern 1 (see FIG. 13) and the case where the position of the clogging of a foreign matter is in the lock pattern 2 are considered (see FIG. 14).

In a case where the oil pressure feedback correction value is negative, the oil control valve 171 is in a state where the oil pressure is not lowered even when it is intended to lower the oil pressure and hence, the ECU 71 determines that the position of the clogging of a foreign matter is in the lock pattern 1. In this case, a direction along which the spool valve 182 moves toward a proximal end side of the sleeve 181 is decided as the direction of cleaning.

In a case where the oil pressure feedback correction value is positive, the oil control valve 171 is in a state where the oil pressure is not increased even when it is intended to increase the oil pressure and hence, the ECU 71 determines that the position of the clogging of a foreign matter is in the lock pattern 2. In this case, a direction along which the spool valve 182 moves toward a distal end side of the sleeve 181 is decided as the direction of cleaning.

[First Severe Clogging Determination Processing]

Next, the first severe clogging determination processing that the ECU 71 performs is described with reference to FIG. 18.

Figure 18:
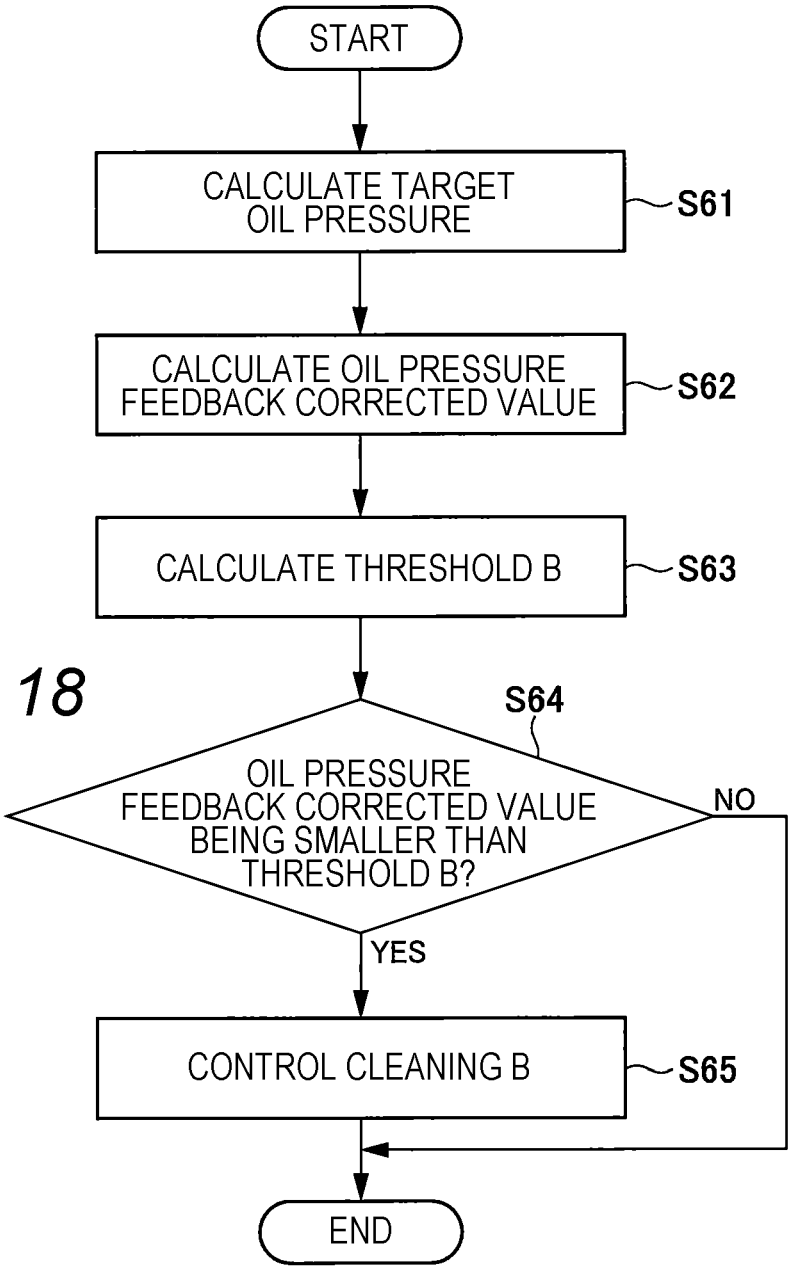
FIG. 18 is a flowchart illustrating first severe clogging determination processing performed by the ECU according to the embodiment 1.

FIG. 18 is a flowchart illustrating first severe clogging determination processing.

First, the ECU 71 calculates a target oil pressure (S61). Next, the ECU 71 calculates an oil pressure feedback correction value (a correction current) based on a difference between the target oil pressure and an actual oil pressure (S62).

Next, the ECU 71 calculates a severe clogging determination threshold B (hereinafter, referred to as a "threshold B") (S63). The threshold B is a value for determining a state where it is necessary to perform a strong cleaning control. The threshold B is within a range of upper and lower limits of the oil pressure feedback correction value, and is set to a value equal to or more than the threshold −A2 and less than the threshold −A1.

Next, the ECU 71 determines whether or not the oil pressure feedback correction value calculated in step S62 is smaller than the threshold B (S64).

In step S64, in a case where the ECU 71 determines that the oil pressure feedback correction value is equal to or more than the threshold B (NO determination in S64), the ECU 71 finishes the first severe clogging determination processing, and performs the second severe clogging determination processing. Accordingly, the ECU 71 determines that the clogging of a foreign matter is not the first severe clogging.

On the other hand, in step S64, in a case where the ECU 71 determines that the oil pressure feedback correction value is smaller than the threshold B (YES determination in S64), the ECU 71 determines that the clogging is the first severe clogging, and decides the cleaning B control as the content of the cleaning (S65). Then, the ECU 71 finishes the first severe clogging determination processing.

In a case where the ECU 71 determines that the clogging of a foreign matter is the first severe clogging, the ECU 71 determines that the position of the clogging of a foreign matter is in the second lock pattern. The ECU 71 determines that the state of clogging of a foreign matter is a state where a foreign matter sticks to a proximal end side edge portion of the spool valve 182 or the oil passing hole 181*b*. In this case, a direction along which the spool valve 182 moves toward the distal end side of the sleeve 181 is decided as the direction of cleaning.

[Second Severe Clogging Determination Processing]

Next, the second severe clogging determination processing that the ECU 71 performs is described with reference to FIG. 19.

Figure 19:
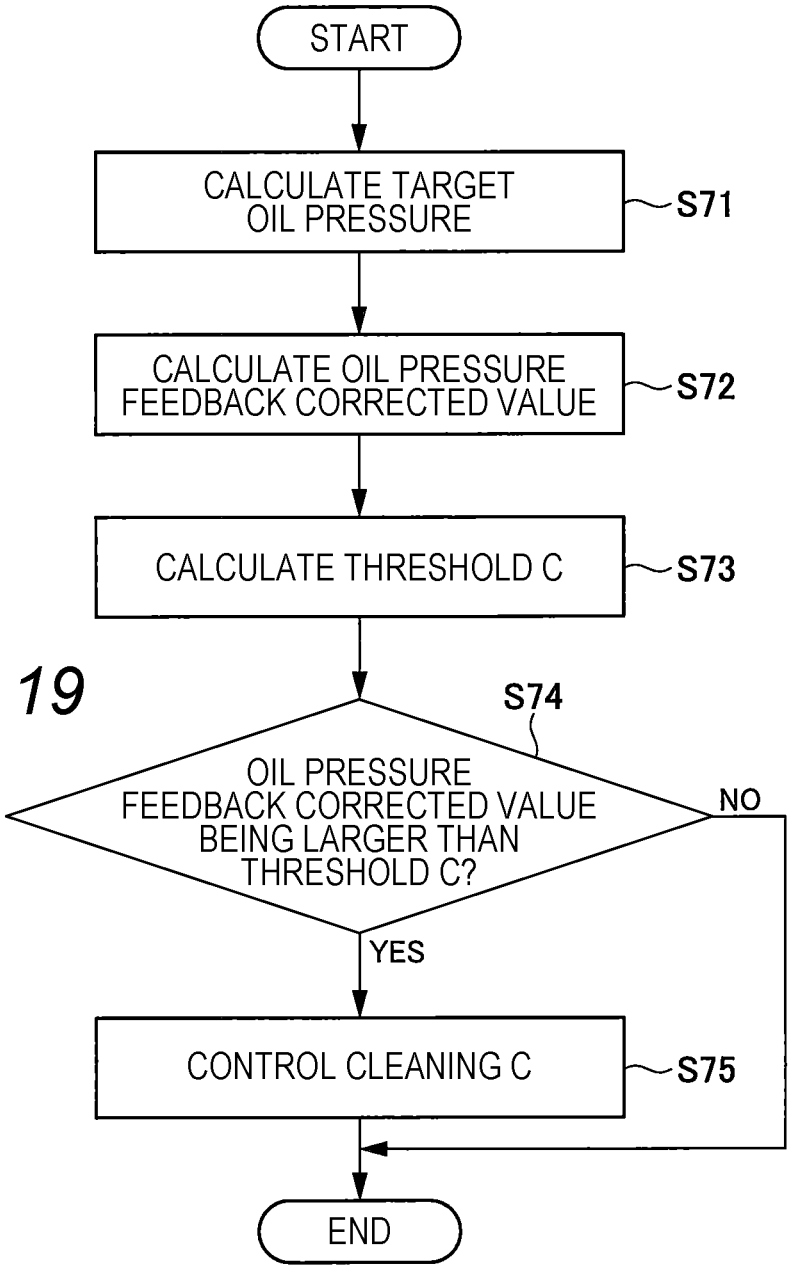
FIG. 19 is a flowchart illustrating second severe clogging determination processing performed by the ECU according to the embodiment 1.

FIG. 19 is a flowchart illustrating second severe clogging determination processing.

First, the ECU 71 calculates a target oil pressure (S71). Next, the ECU 71 calculates an oil pressure feedback correction value (a correction current) based on a difference between the target oil pressure and an actual oil pressure (S72).

Next, the ECU 71 calculates a severe clogging determination threshold C (hereinafter, referred to as a "threshold C") (S73). The threshold C is a value for determining a state where it is necessary to perform a strong cleaning control. The threshold C is within a range of upper and lower limits of the oil pressure feedback correction value, and is set to a value equal to or less than the threshold A2 and larger than the threshold A1.

Next, the ECU 71 determines whether or not the oil pressure feedback correction value calculated in step S72 is larger than the threshold C (S74).

In step S74, in a case where the ECU 71 determines that the oil pressure feedback correction value is equal to or less than the threshold C (NO determination in S74), the ECU 71 finishes the second severe clogging determination processing. Accordingly, the ECU 71 determines that the clogging of a foreign matter is not the second severe clogging. Then, the ECU 71 finishes the second severe clogging determination processing.

On the other hand, in step S74, in a case where the ECU 71 determines that the oil pressure feedback correction value is larger than the threshold C (YES determination in S74), the ECU 71 determines the cleaning C control as the content of the cleaning (S65). Then, the ECU 71 finishes the second severe clogging determination processing.

In a case where the ECU 71 determines that the clogging of a foreign matter is the second severe clogging, the ECU 71 determines that the position of the clogging of a foreign matter is in the first lock pattern. The ECU 71 determines that the state of clogging of a foreign matter is a state where a foreign matter bites into a distal end side edge portion of the spool valve 182 or the oil passing hole 181*b*. In this case, a direction along which the spool valve 182 moves toward the distal end side of the sleeve 181 is decided as the direction of cleaning.

[Contents of Cleaning Control]

Next, contents and effects of the cleaning control are described with reference to FIG. 20.

FIG. 20 is a table illustrating the contents of the cleaning control.

As illustrated in FIG. 20, the cleaning control includes a cleaning A control, a cleaning B control, and a cleaning C control as types of the cleaning control.

(Cleaning A Control)

The cleaning A control is a cleaning control performed by estimating a phenomenon where a foreign matter is caught by the spool valve 182. As the timing that the cleaning A control is performed, timing immediately after occurrence of clogging of a foreign matter is estimated.

In the cleaning A control, the spool valve 182 is vibrated by changing a current in a direction opposite to a correction current calculated by an oil pressure feedback control based on a target control current. In the cleaning A control, as described above, the vibration may be applied to the spool valve 182 while moving the spool valve 182 in the direction that the opening of the oil passing hole 181*b* is widened.

By performing the cleaning A control, it is possible to remove a foreign matter caught on the spool valve 182 without applying an excessive force to the foreign matter. The cleaning A control vibrates the spool valve 182 and hence, the cleaning A control is referred to as a vibration mode.

(Cleaning B Control)

The cleaning B control is a cleaning control performed by estimating a phenomenon where a foreign matter adheres to the spool valve 182 or the proximal end side edge portion of the oil passing hole 181*b*. In this case, the oil pressure is not increased (low oil pressure), and the spool valve 182 does not return to the proximal end side of the sleeve 181 even when being biased by the spring force of the valve biasing spring 173. As the timing that the cleaning B control is performed, the timing is estimated at which a foreign matter cannot be removed even when a vibration mode is performed in a state where an oil pressure is not increased.

In the cleaning B control, the supply of electricity to the oil control valve 171 is set from 0% to 100%, and the spool valve 182 is moved to the distal end side of the sleeve 181. The electricity supply time at this point of time is set longer than the electricity supply time described later in the cleaning C control. This is because the rod 189 is separated from the spool valve 182 when the supply of electricity is set to 0%, and a stroke of the rod 189 is long.

By performing the cleaning B control, it is possible to selectively give an impact to the fixing of a foreign matter in a state where the oil pressure is not increased (low oil pressure) and hence, it is possible to increase a success rate of the peeling off of the foreign matter. In cleaning B control, the spool valve 182 is moved so as to peel off the foreign matter. Accordingly, the cleaning B control is referred to as a peeling-off mode.

(Cleaning C Control)

The cleaning C control is a cleaning control by estimating a phenomenon where the oil passing hole 181*b* or a distal end side edge of the spool valve 182 bites into a foreign matter. In this case, an oil pressure is not lowered (high oil pressure), and the spool valve 182 cannot be moved even when the spool valve 182 is pressed by the rod 189. As the timing that the cleaning C control is performed, the case is estimated where a foreign matter cannot be removed even when a vibration mode is performed in a state where an oil pressure is not lowered.

In the cleaning C control, the supply of electricity to the oil control valve 171 is switched from 0% to 100% so that the spool valve 182 is moved to the distal end side of the sleeve 181. The electricity supply time at this time is shorter than the electricity supply time in the peeling-off mode. This is because the rod 189 approaches the spool valve 182 when the supply of electricity is set to 0% so that a stroke of the rod 189 is short.

By performing the cleaning C control, it is possible to selectively give an impact to the fixing of a foreign matter in a state where the oil pressure is not lowered (high oil pressure). Accordingly, it is possible to selectively impart an impact to fixing of a foreign matter and hence, it is possible to increase a success rate of the scraping off the foreign matter. In cleaning C control, the spool valve 182 is moved so as to scrape off the foreign matter. Accordingly, the cleaning C control is referred to as a scraping-off mode.

As has been described heretofore, the ECU 71 (the control device) according to the present embodiment controls the oil control valve 171 (the hydraulic control valve) that controls the pump capacity of the variable displacement oil pump 54. The oil control valve 171 includes: the sleeve 181; and the spool valve 182 that moves in the sleeve 181. The oil control valve 171 is configured to change a pump capacity by controlling an oil pressure by moving the spool valve 182 between one end (distal end) portion and the other end (proximal end) portion in the sleeve 181. The ECU 71 includes: the control signal outputting unit 224 (the drive control unit) that controls driving of the spool valve 182; and the determination unit 225 that determines whether or not clogging of a foreign matter exists between the sleeve 181 and the spool valve 182, and determines the position of the clogging of the foreign matter when the clogging of the foreign matter exists.

Accordingly, in a case where the clogging of a foreign matter exists, the position of the clogging of the foreign matter can be specified. As a result, by cleaning the position of the clogging of a foreign matter, a removal rate of the foreign matter clogged in the oil control valve 171 can be enhanced.

Further, the determination unit 225 determines whether or not the clogging of a foreign matter exists based on a difference between a target oil pressure and an actual hydraulic pressure when the spool valve 182 is driven.

Accordingly, it is possible to easily determine whether or not the clogging of a foreign matter exists. Further, it is not necessary to provide a detection unit that detects the clogging of a foreign matter in the oil control valve 171. Accordingly, the increase of a manufacturing cost of the oil control valve 171 can be suppressed.

Further, the determination unit 225 determines the position of the clogging of a foreign matter based on a difference between a target oil pressure and an actual hydraulic pressure at the time of driving the spool valve 182.

Accordingly, the position of the clogging of a foreign matter can be easily determined. Further, it is not necessary to provide a detection unit that detects the position of the clogging of a foreign matter in the oil control valve 171. Accordingly, the increase of a manufacturing cost of the oil control valve 171 can be suppressed.

When in a case where the determination unit 225 determines that the clogging of a foreign matter exists, the determination unit 225 decides the content of the cleaning based on the position of the clogging of the foreign matter.

Accordingly, it is possible to perform cleaning in conformity with the position of the foreign matter. As a result, a removal rate of a foreign matter clogged in the oil control valve 171 can be enhanced.

Further, the content of the cleaning includes: a vibration mode for vibrating the spool valve 182; a peeling-mode for peeling off a foreign matter by increasing the opening area of the oil passing hole in which the clogging of a foreign matter has occurred by moving the spool valve 182, a scraping-off mode for removing the foreign matter due to a scraping-off action caused between the sleeve 181 and the spool valve 182 by moving the spool valve 182.

Accordingly, in the vibration mode, a foreign matter can be removed without applying an excessive force to the foreign matter. In the peeling-off mode, in a case where the spool valve 182 can be moved in a direction of increasing the opening area of the oil passing hole, a foreign matter can be removed by applying an impact to the foreign matter. In the scraping-off mode, in a case where the spool valve 182 cannot be moved in a direction of increasing the opening area of the oil passing hole, a foreign matter can be removed by applying an impact to the foreign matter.

Further, the determination unit 225 determines at least one of the vibration mode, the peeling-off mode, and the scraping-off mode as the content of cleaning. For example, in a case where a foreign matter cannot be removed by the vibration mode, the foreign matter may be removed by the peeling-off mode or the scraping-off mode.

As a result, a removal rate of a foreign matter clogged in the oil control valve 171 can be enhanced.

Further, the determination unit 225 determines whether or not the content of the decided cleaning can be performed. Then, in a case where the content of the cleaning can be performed, the control signal outputting unit 224 controls the driving of the spool valve 182 so as to make the spool valve 182 perform cleaning.

Accordingly, in a case where the content of the cleaning cannot be performed, the cleaning is not performed and hence, it is possible to prevent an excessive load from being applied to the oil control valve 171.

The present invention is not limited to the embodiments described above and illustrated in the drawings, and various modifications can be made without departing from the gist of the invention described in the claims. Further, the above-mentioned embodiments have been described in detail to facilitate the understanding of the present invention, and are not necessarily limited to those embodiments having all the described configurations.

REFERENCE SIGNS LIST

1 throttle sensor
2 air flow sensor
2A intake air temperature sensor
3 water temperature sensor
7 crank angle sensor
8 air-fuel ratio
13 cam angle sensor
14 acceleration degree-of-opening sensor
17 neutral switch
18 air conditioner switch
19 accessory load switch
20 fuel pump
21 fuel tank
22 pressure regulator
23 injector
30 power transistor
33 ignition plug
35 knock sensor
40 throttle valve
42 throttle drive motor
54 variable displacement oil pump
60 air cleaner
61 duct
62 collector
65 internal combustion engine
71 ECU
72 ignition switch
74 oil pressure sensor
74A oil temperature sensor
75 radiator fan
78 CPU
79 power supply IC
81 exhaust pipe
82 catalyst
90 valve timing variable solenoid
91 valve timing variable mechanism
100 oil pan
101 oil strainer
102 oil cooler
103 oil filter
104 relief valve
110 main gallery
111 main bearing
112 crankshaft
113 connecting rod bearing
114 connecting rod
121 piston oil jet
122 piston
131 chain oil jet
132 chain tensioner
140 internal variable valve mechanism oil filter
141 internal variable valve mechanism solenoid valve
142 variable valve mechanism
143 cam journal
144 external camshaft
145 external cam journal
146,149 valve lifter
147 internal camshaft
148 internal cam journal
161 housing
162 drive shaft
163 vane
164 rotor
165 cam ring
165*a* lever portion
166*a* sealing member
167,168 operation chamber
169 pivot pin
171 oil control valve
172 vane ring
181 sleeve
181*a* oil introducing hole
181*b* oil passing hole
181*c* stopper
182 spool valve
182*a* first land portion
182*b* second land portion
182*c* annular passage groove
182*d* oil passage
182*e* stepped surface
184 electromagnetic solenoid
185 solenoid casing
186 electromagnetic coil
187 fixed yoke
187*a* stepped surface
188 movable plunger
189 rod
189*a* flange
200 lubrication required flow rate
201 working oil required flow rate
202 cooling required flow rate
203 working oil required oil pressure
204 cooling required oil pressure
205 lubrication required oil pressure
206 flow rate adjusting unit
207 oil pressure adjusting unit
210 mechanical noise intensity calculation
211 mechanical noise correction calculation

212,213 viscosity correction calculation
224 control signal outputting unit
225 determination unit
226 conversion unit
227 target controlled variable determination unit

The invention claimed is:

1. A control device for a hydraulic control valve that controls a pump capacity of a variable displacement oil pump, wherein the hydraulic control valve includes: an electromagnetic solenoid, a sleeve that is fixed to the electromagnetic solenoid; and a spool valve that moves in the sleeve, and is configured to change the pump capacity by controlling an oil pressure by moving the spool valve between one end portion and the other end portion in the sleeve using a magnetic attractive force generated when a current flows into the electromagnetic solenoid, and the control device for a hydraulic control valve further includes:

a drive control unit that adds a target control current based on a target oil pressure when moving the spool valve, and a correction current value calculated based on a difference between the target oil pressure and an actual oil pressure, and controls driving of the electromagnetic solenoid; and a determination unit that determines whether or not clogging of a foreign matter exists between the sleeve and the spool valve, and determines a position of the clogging of the foreign matter in a case where the clogging of the foreign matter exists based upon the correction current value, wherein the determination unit determines, in a case where a state is brough about where the actual oil pressure cannot be lowered relative to the target oil pressure, a distal end side of the sleeve in an edge portion of an oil passing hole in the sleeved, communicating with the variable displacement oil pump, to be the position of the clogging of the foreign matter, and in a case where a state is brought about where the actual oil pressure cannot be increased relative to the target oil pressure, a proximal end side of the sleeve in the edge portion of the oil passing hole to be the position of the clogging of the foreign matter, and decides a content of cleaning based on the position of the clogging of the foreign matter, and the correction current value.

2. The control device for a hydraulic control valve according to claim 1, wherein the determination unit determines the content of cleaning to a vibration mode for vibrating the spool value, in case where the correction current value exceeds a range in a normal state, and the correction current value is within a range of a slight abnormality.

3. The control device for a hydraulic control valve according to claim 2, wherein the determination unit determines, in a case wherein the correction current value exceeds a range in a normal state, and the correction current value is smaller than a first sever clogging determination threshold, that a state has been brought about where the actual oil pressure cannot be increased relative to the target oil pressure, and a peeling-off mode for peeling off a foreign matter from the proximal end side of the sleeve by performing 100% supply of electricity to the electromagnetic solenoid for a predetermined electricity supply time, to the content of cleaning, and in a case wherein the correction current value exceeds a range in a normal state and the correction current value is larger than a second severe clogging determination threshold, that a state has been brought about where the actual oil pressure cannot be lowered relative to the target oil pressure, and a scraping-off mode for scraping off a foreign matter from the distal end side of the sleeved by performing 100% supply of electricity to the electromagnetic solenoid for an electricity supply time shorter than the electricity supply time in the peeling-off mode, to the content of cleaning.

4. The control device for a hydraulic control valve according to claim 2, wherein the determination unit determines whether or not the content of the decided cleaning can be performed, and the drive control unit controls driving of the spool valve so as to perform the cleaning in a case where the content of the cleaning can be performed.

* * * * *